US007625242B2

(12) United States Patent
Axland et al.

(10) Patent No.: US 7,625,242 B2
(45) **Date of Patent: *Dec. 1, 2009**

(54) MOUNTABLE POWER STRIPS HAVING ARM SECTIONS AND LEVER ARM

(75) Inventors: Mark Axland, Charlotte, NC (US); Ian D. Kovacevich, Charlotte, NC (US); Kevin J. Dahlquist, Charlotte, NC (US); Daniel Lee Bizzell, Davidson, NC (US); Cheryl Axland, Charlotte, NC (US)

(73) Assignee: Axland Comec, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/164,322

(22) Filed: Jun. 30, 2008

(65) Prior Publication Data

US 2008/0268715 A1 Oct. 30, 2008

Related U.S. Application Data

(63) Continuation of application No. 11/746,040, filed on May 8, 2007.

(60) Provisional application No. 60/746,757, filed on May 8, 2006.

(51) Int. Cl.
*H01R 33/92* (2006.01)

(52) U.S. Cl. ..... 439/640

(58) Field of Classification Search ..... 439/640, 439/655, 651, 170; 362/296, 806
See application file for complete search history.

(56) References Cited

U.S. PATENT DOCUMENTS 1,891,341 A * 12/1932 Barocas ..... 439/574
2,047,045 A * 7/1936 Nicholas ..... 362/249
2,230,900 A 2/1941 Neitzke
2,453,695 A 11/1948 Belling
2,465,419 A * 3/1949 Barany ..... 439/284
2,474,356 A 6/1949 Harris
2,533,222 A 12/1950 Cohen
2,759,095 A 8/1956 Kline
3,049,688 A 8/1962 Sinopoli
3,662,319 A * 5/1972 Culver ..... 439/502
3,723,723 A 3/1973 Lemer
3,752,407 A 8/1973 Baugh et al.
3,770,951 A 11/1973 Corelli et al.
4,099,824 A 7/1978 Schoppelrey
4,174,532 A * 11/1979 Kelley ..... 362/102
4,764,128 A * 8/1988 Cheng ..... 439/652
4,875,878 A 10/1989 Meyer (Continued)

OTHER PUBLICATIONS

Information Disclosure Statement (IDS) Letter Regarding Common Patent Application(s), submitted by Applicant on Feb. 11, 2009.

*Primary Examiner*—Khiem Nguyen
(74) *Attorney, Agent, or Firm*—Tillman Wright, PLLC; Chad D. Tillman; Jeremy C. Doerre

(57) ABSTRACT

A mountable power strip includes: a first arm section; a second arm section; a lever arm connected to the second arm section; and a coupling assembly configured to couple the first and second arm sections together such that the first and second arm sections are configured for relative rotational movement between an open position for receipt of an object therebetween; and a closed position wherein the first and second arm sections are closer to one another than when in the open position for clamping engagement with the object. The first arm section includes a plurality of electrical receptacles positioned adjacent each other along an extent of the first arm section such that the plurality of electrical receptacles form a "strip" of electrical receptacles. Methods of use include mounting a power strip to an object.

21 Claims, 24 Drawing Sheets

U.S. PATENT DOCUMENTS

| | | | | |
|---|---|---|---|---|
| 5,150,963 | A | | 9/1992 | Hill |
| 5,306,165 | A | | 4/1994 | Nadeau |
| 5,422,801 | A | * | 6/1995 | Sangalli, Jr. ..... 362/252 |
| D365,803 | S | | 1/1996 | Boesel et al. |
| 5,964,618 | A | | 10/1999 | McCarthy |
| D428,598 | S | | 7/2000 | Carter-Williams et al. |
| D436,922 | S | | 1/2001 | Stekelenburg |
| D437,582 | S | | 2/2001 | Stekelenburg |
| 6,243,257 | B1 | | 6/2001 | Ester |
| D467,875 | S | | 12/2002 | Barger et al. |
| 6,540,554 | B2 | | 4/2003 | McCarthy |
| 6,581,890 | B2 | | 6/2003 | Johnson et al. |
| 6,663,435 | B2 | | 12/2003 | Lincoln, III et al. |
| 6,933,447 | B1 | | 8/2005 | Marc |
| 7,148,419 | B1 | | 12/2006 | Harrigan |
| 7,186,146 | B1 | | 3/2007 | Chang et al. |
| 7,223,122 | B2 | | 5/2007 | Mori |
| 7,347,734 | B1 | | 3/2008 | Teitelbaum |
| 7,394,019 | B2 | | 7/2008 | Gesue |
| 7,435,901 | B2 | | 10/2008 | Mori et al. |
| 7,442,090 | B2 | | 10/2008 | Mori et al. |
| 2008/0066943 | A1 | | 3/2008 | Axland et al. |
| 2008/0261455 | A1 | | 10/2008 | Axland et al. |
| 2008/0261456 | A1 | | 10/2008 | Axland et al. |
| 2008/0277133 | A1 | | 11/2008 | Axland et al. |

* cited by examiner

22000′

22000′

MOUNTABLE POWER STRIPS HAVING ARM SECTIONS AND LEVER ARM

I. CROSS-REFERENCE TO RELATED APPLICATIONS

The present application is a continuation patent application of, and claims priority under 35 U.S.C. §120 to, U.S. patent application Ser. No. 11/746,040, filed May 8, 2007, which '040 application published on Mar. 20, 2008 as U.S. Patent Application Publication No. 2008/0066943, and which '040 application is a nonprovisional patent application of, and claims priority under 35 U.S.C. §119(e) to, U.S. Provisional Patent Application Ser. No. 60/746,757, filed May 8, 2006. Each of these patent applications and the patent application publication is incorporated herein by reference.

II. COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

III. BACKGROUND OF THE INVENTION

The present invention generally relates to various new designs for power strips and, in particular, to designs for a power strip that includes structure that facilitates the mounting or attachment of the power strip to an object.

IV. SUMMARY OF THE INVENTION

The present invention includes many aspects and features. Moreover, while power strips of the present invention may be used by mounting them to trees and, in particular, to Christmas Trees, the present invention is not limited to use only with trees. Indeed, as will become apparent from the following, power strips of the present invention have broad applicability and can be mounted or attached to many different objects and structures apart from trees, such as a portion of a stud in the frame of a building that is under construction, or a portion of a work bench or table.

In accordance with an aspect of the invention disclosed and claimed in the present application, a mountable power strip includes a plurality of arm sections with a first of the arm sections including a plurality of electrical receptacles positioned adjacent each other along an extent thereof so as to define a "strip" of electrical receptacles. The mountable power strip further includes a coupling assembly that is configured to couple the arm sections together such that the first arm section and another arm section are configured for rotational movement relative to each other about an axis of the coupling assembly. The first and second arm sections are offset a distance along the axis of the coupling assembly such that the first and second arm sections are configured to transition between, a first configuration, in which the first and second arm sections do not overlap each other when viewed along the axis of the coupling assembly, and a second configuration, in which the first and second arm sections overlap each other when viewed along the axis of the coupling assembly.

In a feature of this aspect, the second arm section includes a plurality of electrical receptacles positioned adjacent each other along an extent of the second arm section, thereby defining a strip of electrical receptacles.

In another feature of this aspect, each of the first and second arm sections extends in a direction that is generally orthogonal to the axis of the coupling assembly.

In still yet another feature of this aspect, each of the first and second arm sections is curved.

In another feature of this aspect, the mountable power strip further includes electrical wiring extending internally through the coupling assembly and the first section for supplying electrical power to the electrical receptacles of the first arm section. With further regard to this feature, a main power cord for supplying electrical power to the internal wiring and, in turn, to each of the electrical receptacles, may extend through an opening in a wall of the second arm section.

In another feature of this aspect, each of the first and second arm sections includes a rigid, arcuate portion extending outwardly away from the coupling assembly.

In another feature of this aspect, the rigid, arcuate portion of the first and second arm sections includes an outer resilient portion that is elastic and capable of resuming its prior shape after deformation. the resilient portion of each of the first and second arm sections may include resilient protuberances for tensioned gripping of an object on which the power strip may be mounted.

In another feature of this aspect, the resilient protuberances preferably are positioned adjacent each other such that they define a row of resilient protuberances.

In another feature of this aspect, each of row of resilient protuberances may extend along the rigid, arcuate portion of its respective arm section; each row of resilient protuberances may be generally offset from a centerline extending along the rigid, arcuate portion of the arm section; and each row of resilient protuberances may be offset from the centerline of its respective arm section in a direction toward the other row of resilient protuberances of the other arm section.

Additionally, each arm section may include a profile having a rounded edge, with the rounded edge being offset toward the other arm section relative to a centerline extending along the rigid, arcuate portion of the arm section.

In another feature of this aspect, each arm section includes a profile that is asymmetrical along a respective centerline of the arm section. Furthermore, the protuberances of each arm section may extend along a rounded edge of the arm section.

In another aspect of the invention disclosed and claimed in the present application, a mountable power strip includes a plurality of arm sections. A first arm section of the plurality of arm sections includes a plurality of electrical receptacles positioned adjacent each other along an extent of the first arm section, thereby defining a strip of electrical receptacles. Additionally, a coupling assembly is configured to couple the plurality of arm sections together such that the first arm section and a second arm section of the plurality of arm sections are configured for rotational movement relative to each other about an axis of the coupling assembly. Moreover, the first and second arm sections are configured to transition between a first configuration, in which the first and second arm sections are oriented in an open position; and a second configuration, in which the first and second arm sections are oriented in a closed position, the first and second arm sections being closer to one another than when in the first configuration. In conjunction therewith, the first and second arm sections each further includes a row of resilient protuberances that are configured for tensioned gripping of an object disposed between the arm sections when the arm sections are in the closed configuration. Each respective row is generally offset from a centerline extending along its respective arm section.

In a feature of this aspect, In a feature of this aspect, each row of resilient protuberances is offset from the centerline of its respective arm section in a direction toward the other row of resilient protuberances of the other arm section.

In a feature of this aspect, the first and second arm sections are offset a distance along the axis of the coupling assembly such that, when in the first configuration, the first and second arm sections do not overlap each other when viewed along the axis of the coupling assembly; and, when in the second configuration, the first and second arm sections overlap each other when viewed along the axis of the coupling assembly.

In another aspect, a method of mounting a power strip on an object includes the steps of: positioning the power strip such that an object extends between first and second arm sections of the power strip, with at least one of the arm sections including a plurality of electrical receptacles positioned adjacent each other along an extent of the arm section so as to define a strip of electrical receptacles; and transitioning the first and second arm sections to a closed position wherein the object is gripped between the first and second arm sections, with both arm sections including a row of resilient protuberances, resilient protuberances of each row being compressed by the object for tensioned gripping of the object.

In yet another aspect of the invention disclosed and claimed in the present application, a mountable power strip includes: a first arm section; a second arm section; a lever arm connected to the second arm section; and a coupling assembly configured to couple the first and second arm sections together such that the first and second arm sections are configured for rotational movement relative to each other about an axis of the coupling assembly. Furthermore, the first and second arm sections are configured to transition between: a first configuration, in which the first and second arm sections are oriented in an open position for receipt of an object between the first and second arm sections; and a second configuration, in which the first and second arm sections are oriented in a closed position, the first and second arm sections being closer to one another than when in the first configuration for clamping engagement with the object. The first arm section includes a plurality of electrical receptacles positioned adjacent each other along an extent of the first arm section such that the plurality of electrical receptacles form a "strip" of electrical receptacles.

In a feature of this aspect, the first arm section includes an elongate portion along which the strip of electrical receptacles is positioned.

In another feature, the second arm section is curved.

In another feature, the first arm section and the lever-arm each includes finger grips for gripping by hand of the first arm section and the lever-arm.

In another feature, the first and second arm sections each includes an outer resilient portion that is elastic and capable of resuming its prior shape after deformation. The resilient portion of the second arm section preferably includes resilient protuberances for tensioned gripping of an object on which the power strip may be mounted; the resilient protuberances of the second arm section preferably are positioned adjacent each other such that the resilient protuberances define a row of resilient protuberances; and the row of resilient protuberances of the second arm section preferably extends along an arcuate portion of the second arm section.

In another feature, the first and second arm sections are spring-biased toward the closed position.

In another feature, the lever arm is connected to the second arm section in fixed disposition relative to the second arm section. The lever arm preferably is spring-biased such that the first and second arm sections are biased toward the closed position.

In another feature, the first and second arm sections are spring-biased toward the closed position.

In another feature, the power strip further includes a main power cord for supplying electrical power to the electrical receptacles, the main power cord being connected to the first arm section at an end of the first arm section.

In another aspect of the invention, a method of mounting a power strip on an object includes: positioning the power strip such that the object extends between a first arm section and a second arm section of the power strip, the first arm section including a plurality of electrical receptacles positioned adjacent each other along an extent of the first arm section so as to define a strip of electrical receptacles; and transitioning the first and second arm sections to a closed position, wherein the object is gripped between the first arm section and the second arm section.

In a feature of this aspect, the second arm section includes a row of resilient protuberances, at least some of which are compressed by the object for tensioned gripping of the object between the first and second arm sections of the power strip.

In another feature of this aspect, the extent of the first arm section that includes the strip of electrical receptacles is linear.

In a feature of this aspect, the power strip used in the method further includes: a lever arm connected to the second arm section; and a coupling assembly configured to couple the first and second arm sections together such that the first and second arm sections are configured for rotational movement relative to each other about an axis of the coupling assembly. Further in this aspect, the first and second arm sections are configured to transition between: a first configuration, in which the first and second arm sections are oriented in an open position for receipt of an object between the first and second arm sections, and a second configuration, in which the first and second arm sections are oriented in a closed position, the first and second arm sections being closer to one another than when in the first configuration for clamping engagement with the object.

With further regard to this feature of the power strip, the first arm section includes an elongate portion along which the strip of electrical receptacles is positioned. Additionally, with regard to this feature of the power strip, the second arm section is curved.

With further regard to this feature of the power strip, the first and second arm sections each includes an outer resilient portion that is elastic and capable of resuming its prior shape after deformation, the outer resilient portions of the arm sections being oriented in opposed facing relationship to each other on an interior side of each arm section, each resilient portion of each arm section being compressed by the object for tensioned gripping of the object between the first and second arm sections of the power strip.

With further regard to this feature of the power strip, the lever arm is connected to the second arm section in fixed disposition relative to the second arm section.

With further regard to this feature of the power strip, the lever arm is spring-biased such that the first and second arm sections are biased toward the closed position.

In yet another aspect of the invention disclosed and claimed in the present application, a mountable power strip includes first and second arm sections. At least one of the first and second arm sections includes a plurality of electrical receptacles. The mounting strip also includes a coupling assembly configured to couple the first and second arm sections together such that the first and second arm sections are configured for rotational movement relative to each other about an axis of the coupling assembly. The first and second arm sections are configured to transition between a first configuration, in which the first and second arm sections are oriented in an open position for receipt of an object between the first and second arm sections; and a second configuration, in which the first and second arm sections are oriented in a closed position, the first and second arm sections being closer to one another than when in the first configuration for clamping engagement with the object. The first and second arm sections also are spring biased toward the closed position, the spring-biasing of the arm sections providing a clamping force for mounting the power strip to an object. Each arm section also is connected to the other arm section by the coupling assembly between opposite end portions of the arm section. One end portion of each arm section also defines a handle grip of the power strip.

In a feature of this aspect, the first and second arm sections generally have the same dimensions and configuration.

In a feature of this aspect, each arm section is connected by the coupling assembly proximate a middle portion of the arm section.

In a feature of this aspect, at least one arm section includes electrical receptacles and, preferably, both arm sections include electrical receptacles (although it is contemplated that only one arm section could include electrical receptacles in this aspect of the invention).

In a feature of this aspect, the power strip resembles a clamp of a pair of jumper cables for a car battery.

In a feature of this aspect, each of the arm sections includes an end portion that defines a guide against which an object may be pushed for parting of the arm sections for mounting of the power strip onto the object. With further regard to this feature, each of the arm sections includes a second end portion opposite the end portion defining the guide. This second end portion defines a handle grip of the mountable power strip.

In another aspect of the invention disclosed and claimed in the present application, a mountable power strip includes first and second arm sections. At least one of the first and second arm sections includes a plurality of electrical receptacles. The mountable power strip further includes a coupling assembly configured to couple the first and second arm sections together such that the first and second arm sections are configured for rotational movement relative to each other about an axis of the coupling assembly; a handle that extends generally linearly from the coupling assembly and that is integral with the first arm section; and a lever arm that extends generally linearly from the coupling assembly and that is integral with the second arm section. The handle has a length that is substantially longer than a length of the lever arm. Furthermore, the first and second arm sections are configured to transition between a first configuration, in which the first and second arm sections are oriented in an open position for receipt of an object between the first and second arm sections; and a second configuration, in which the first and second arm sections are oriented in a closed position, the first and second arm sections being closer to one another than when in the first configuration for clamping engagement with the object. The first and second arm sections also are spring biased toward the closed position, the spring-biasing of the arm sections providing a clamping force for mounting the power strip to an object.

In a feature of this aspect, only the first arm section includes electrical receptacles.

In a feature of this aspect, each of the arm sections includes an end portion that defines a guide against which an object may be pushed for parting of the arm sections for mounting of the power strip onto the object.

In a feature of this aspect, the lever arm includes finger grips.

In a feature of this aspect, the first arm section includes a plurality of electrical receptacles, with at least one electrical receptacle being disposed on a first side of the first arm section and another electrical receptacle being disposed on a second side of the first arm section, the first side being generally orthogonally oriented to the first side.

In a feature of this aspect, each of the first and second arm sections include teeth located on an interior side thereof, the respective teeth of the first and second arm sections being oriented in opposing relation for gripping engagement of an object between the first and second arm sections. The teeth preferably are formed from a durable, resilient material. However, a hard material may be used.

In a feature of this aspect, at least one of the arm sections includes a curved portion that extends from the coupling assembly and that includes a plurality of electrical receptacles located along the curved portion.

In a feature of this aspect, at least one of the arm sections includes two generally planar surfaces that intersect at a generally obtuse angle, at least one electrical receptacle being located on each of the generally planar surfaces of the arm section.

In a feature of this aspect, each of the arm sections includes two generally planar surfaces that intersect at a generally obtuse angle, at least one electrical receptacle being located on each of the generally planar surfaces of the respective arm section.

In a feature of this aspect, the arrangement of the electrical receptacles on the first arm section mirrors the arrangement of the electrical receptacles on the second arm section.

In a feature of this aspect, a first electrical receptacle is located on a top surface of the first arm section, and another electrical receptacle is located on a side surface of the first arm section, the top surface being generally oriented orthogonal to the side surface.

In a feature of this aspect, a first electrical receptacle is located on a first top surface of the first arm section, and another electrical receptacle is located on a second top surface of the first arm section, the second top surface being generally oriented at an obtuse angle to the first top surface of the first arm section.

It further should be noted that the present invention encompasses the various possible combinations of aspects and features of the various embodiments disclosed herein as well as in the incorporated references.

V. BRIEF DESCRIPTION OF THE DRAWINGS

A plurality of preferred embodiments of the present invention now will be described in detail with reference to the accompanying drawings, wherein the same elements are referred to with the same or similar reference numerals, and wherein.

Figure 1:
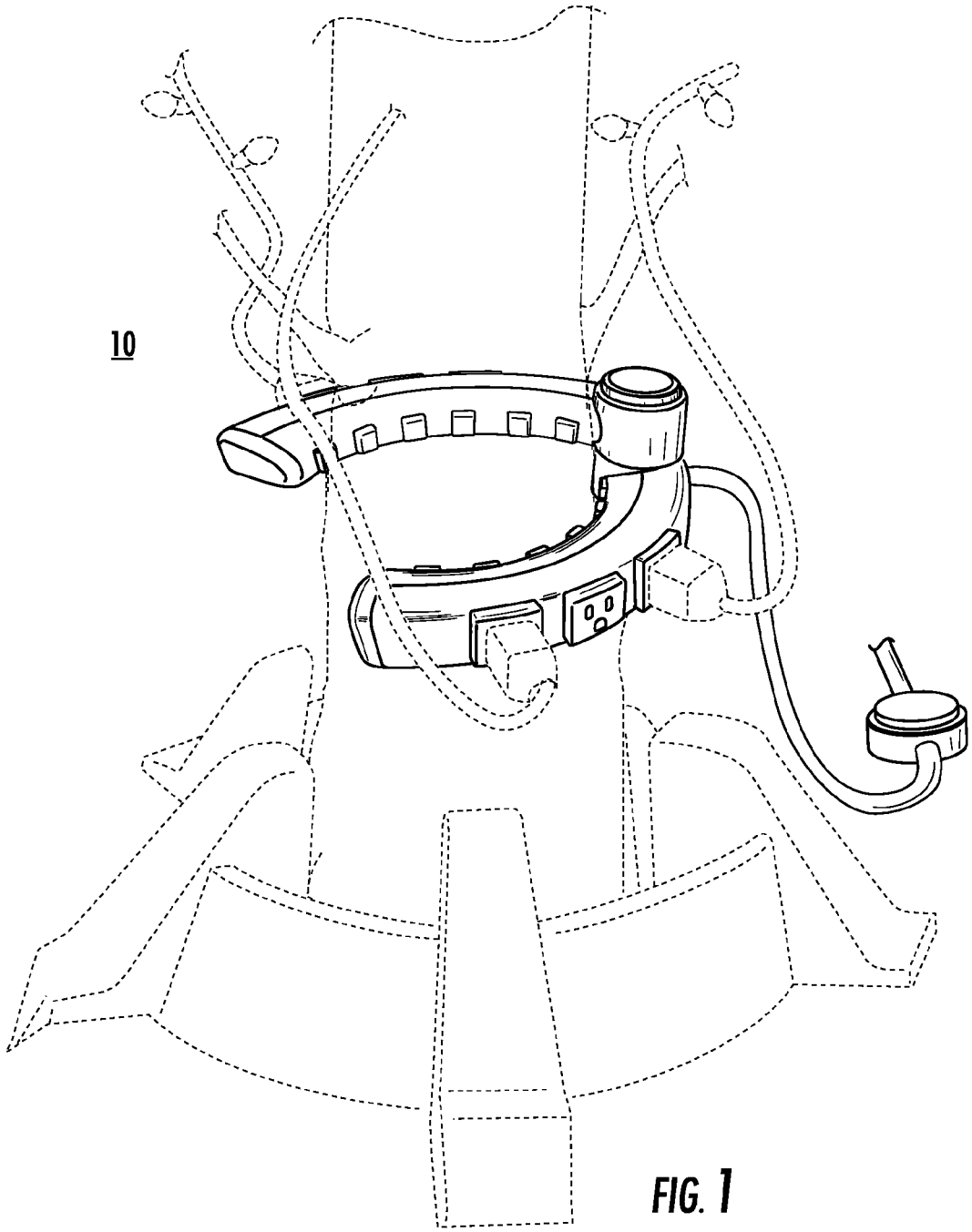
FIG. 1 shows an environmental view of the power strip 10 in accordance with a first illustrated embodiment.
Figure 2:
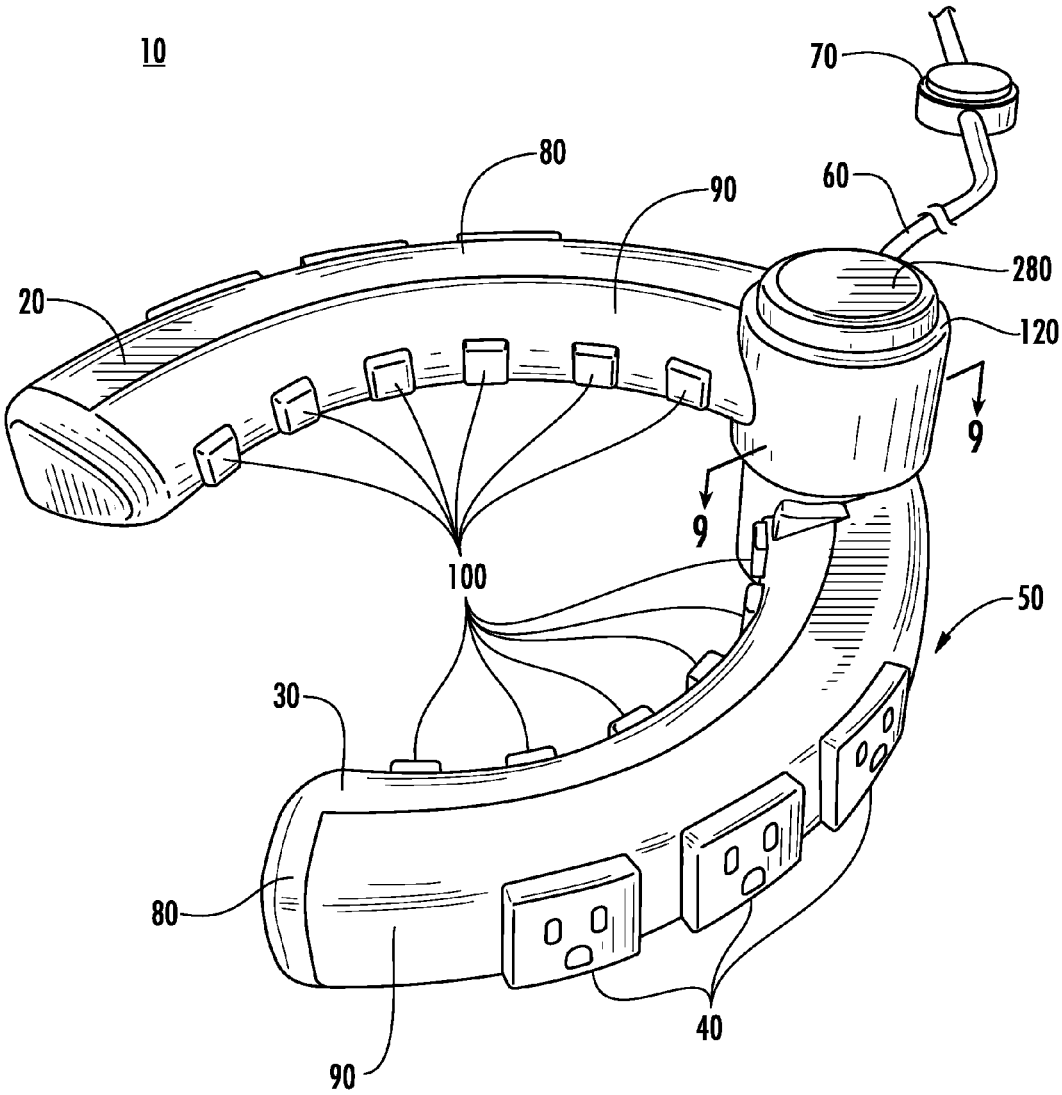
FIG. 2 shows the power strip 10 disposed with arm sections 20,30 in an intermediate position relative to one another.
Figure 3:
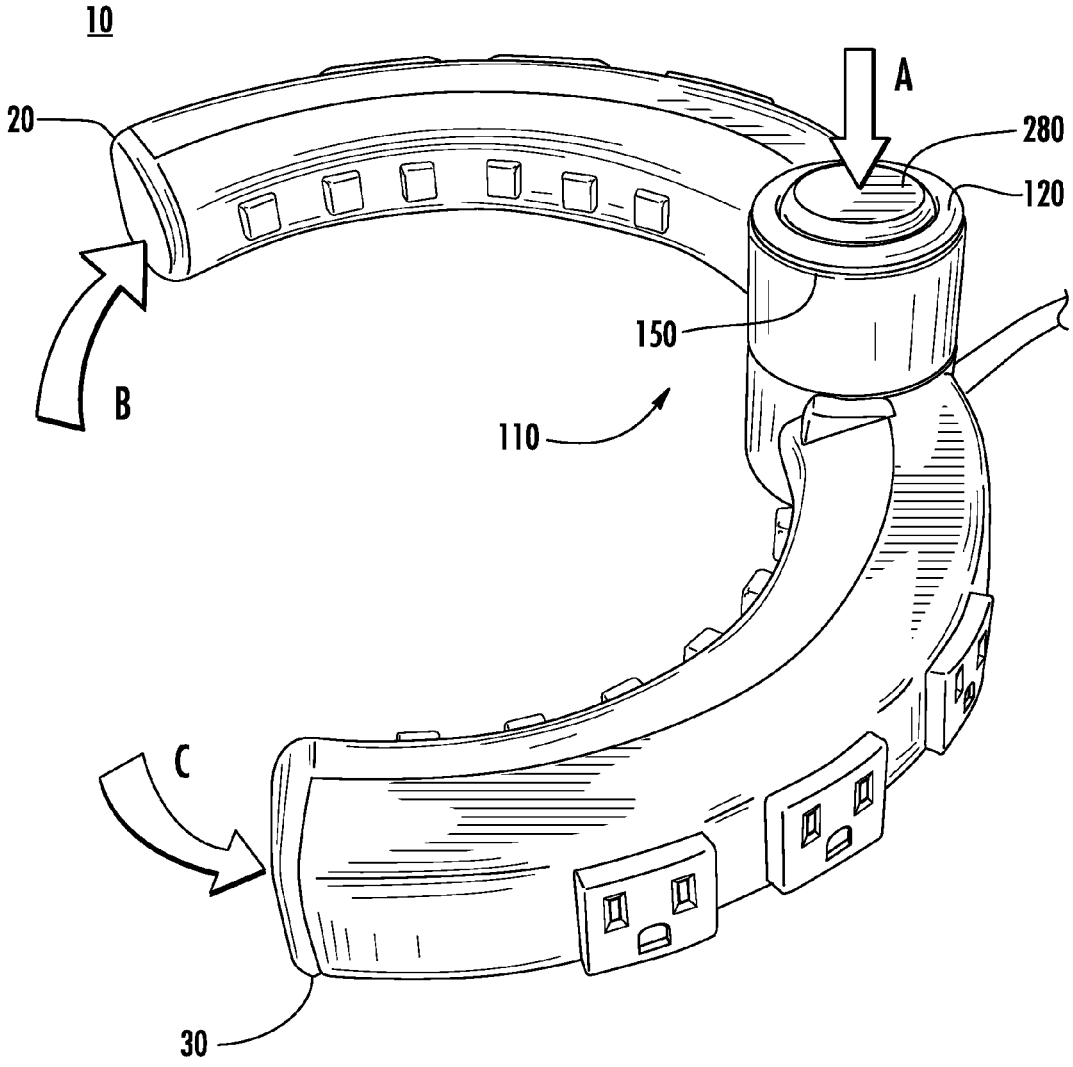
Figure 4:
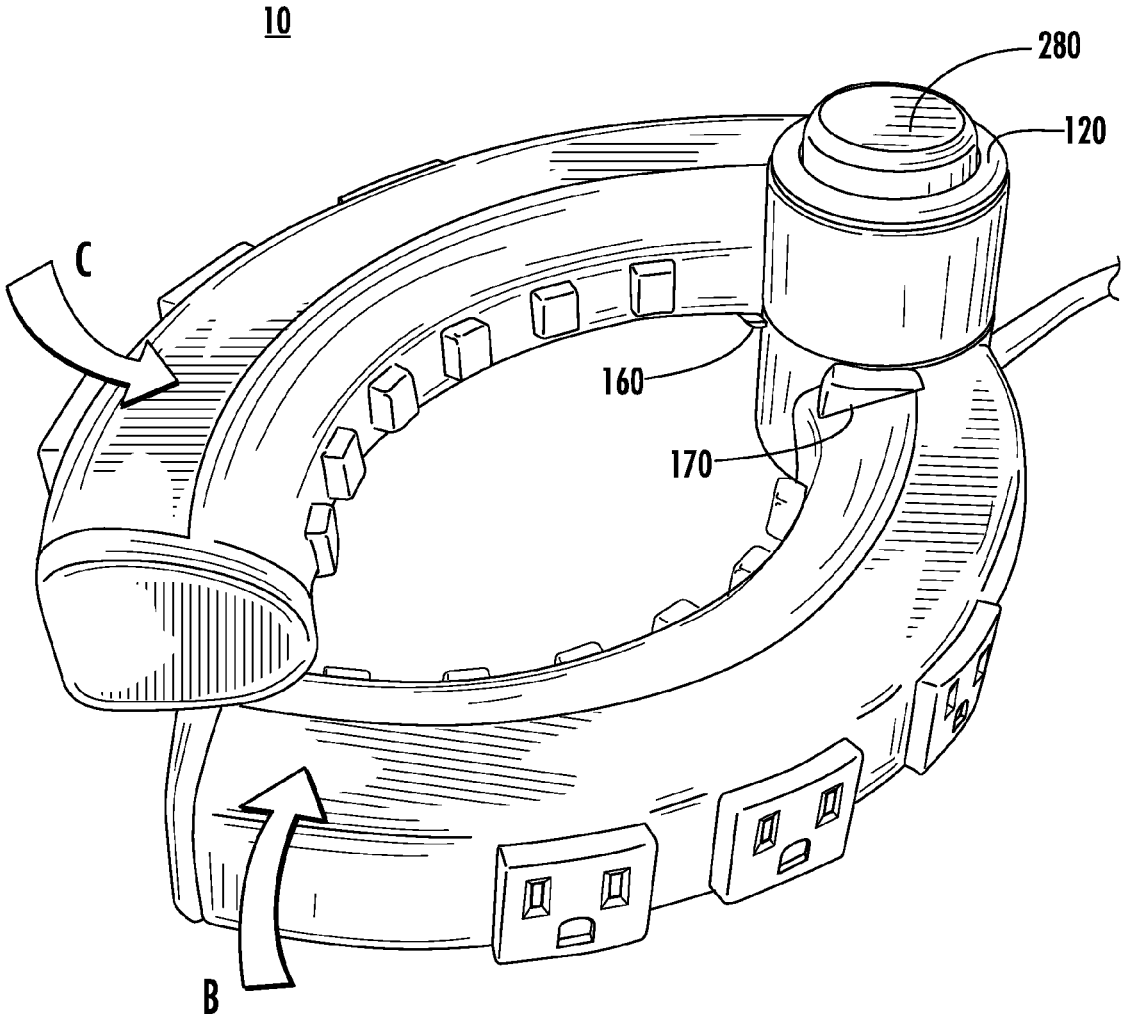
Figure 5:
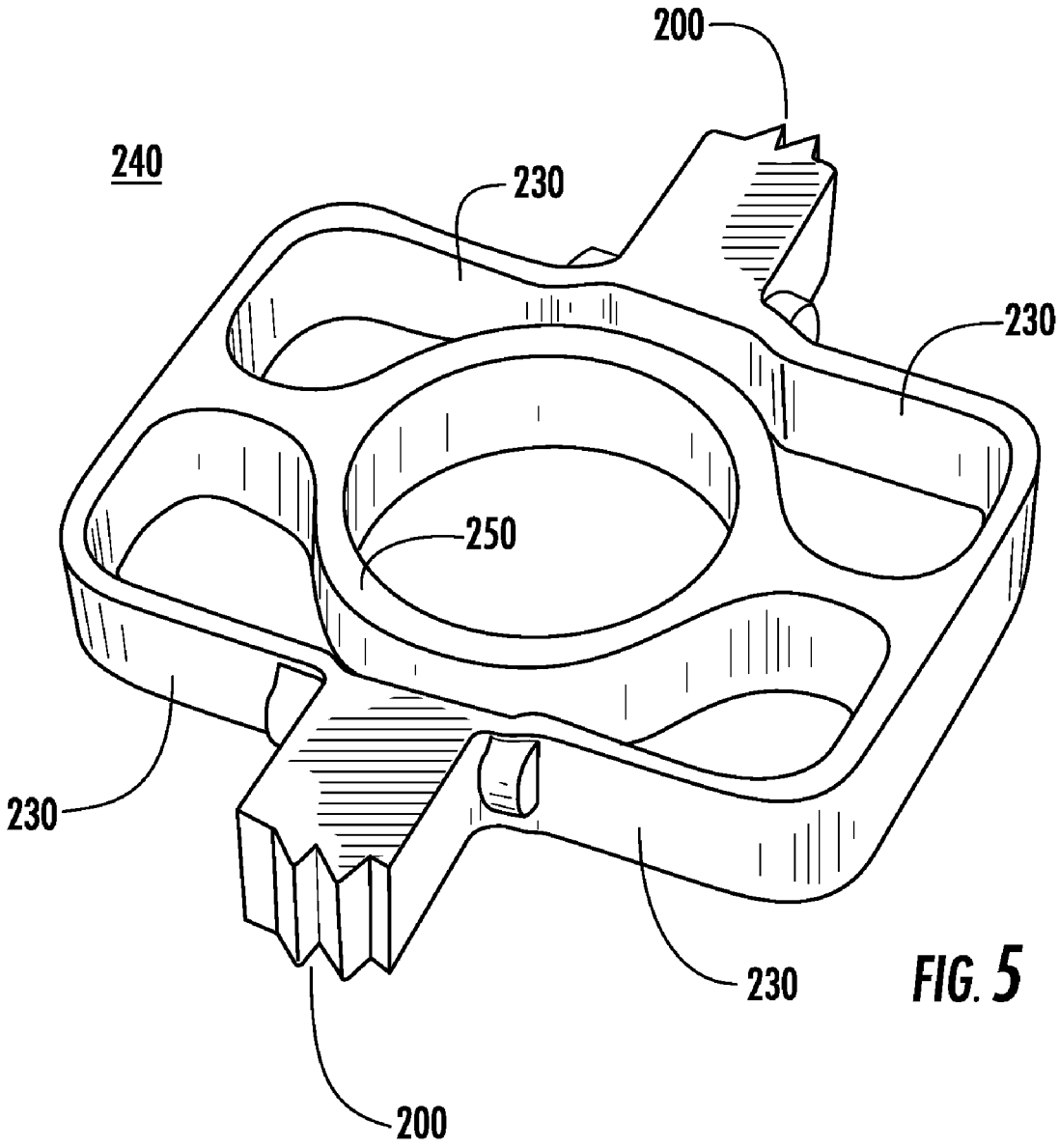
Figure 6:
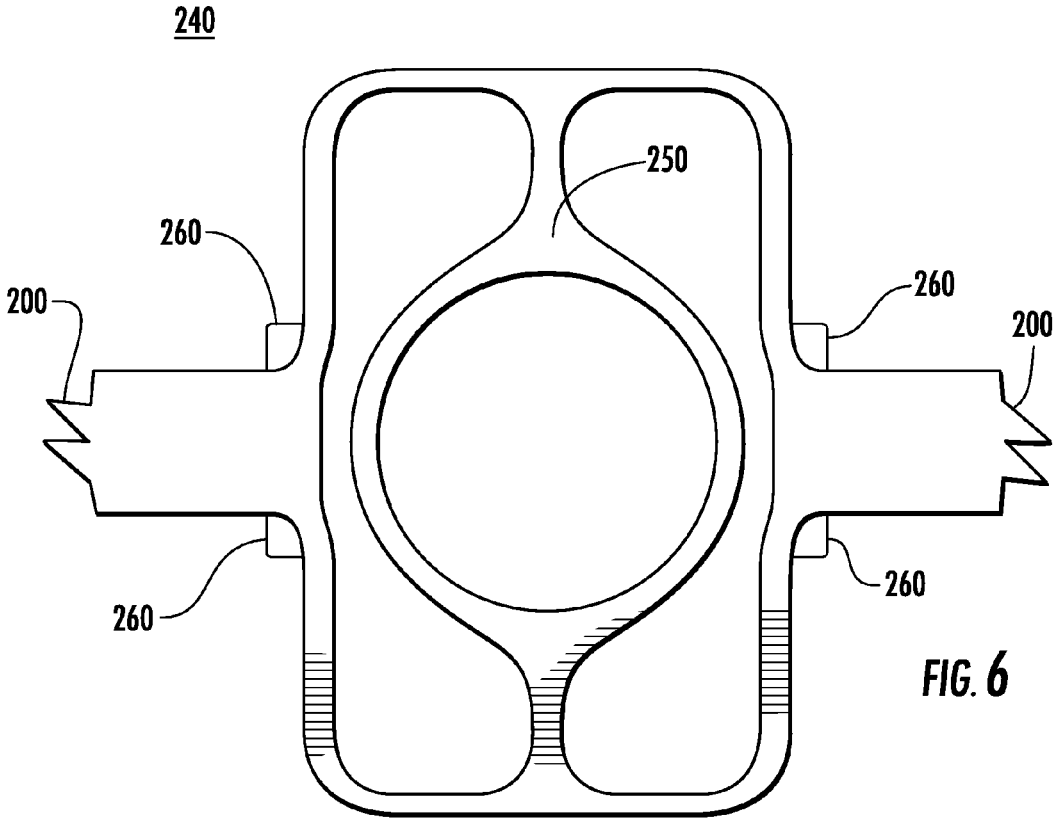
Figure 7:
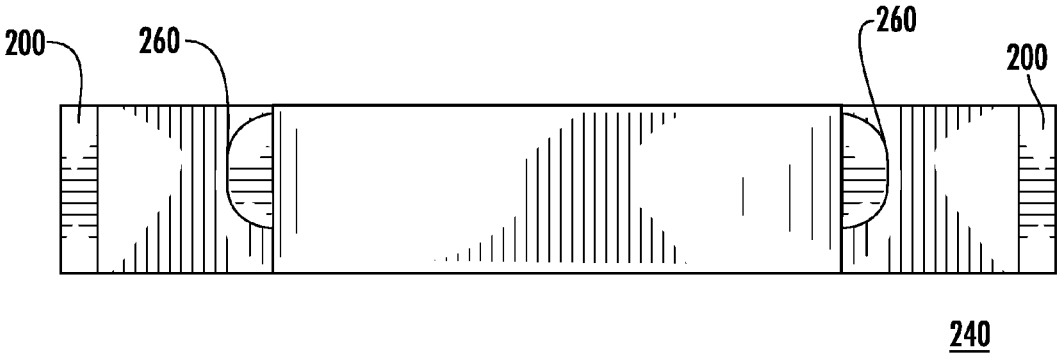
Figure 8A:
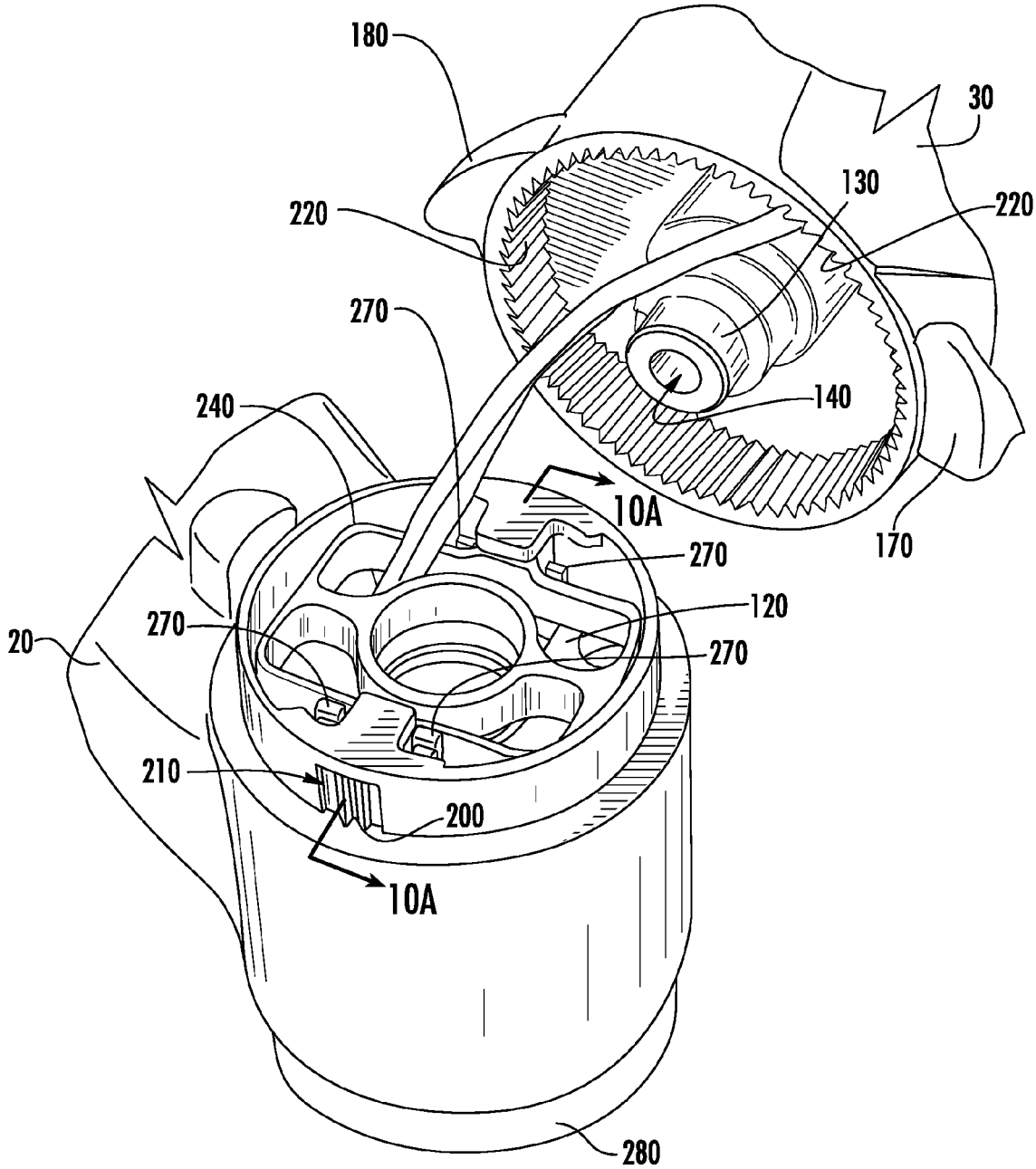
Figure 8B:
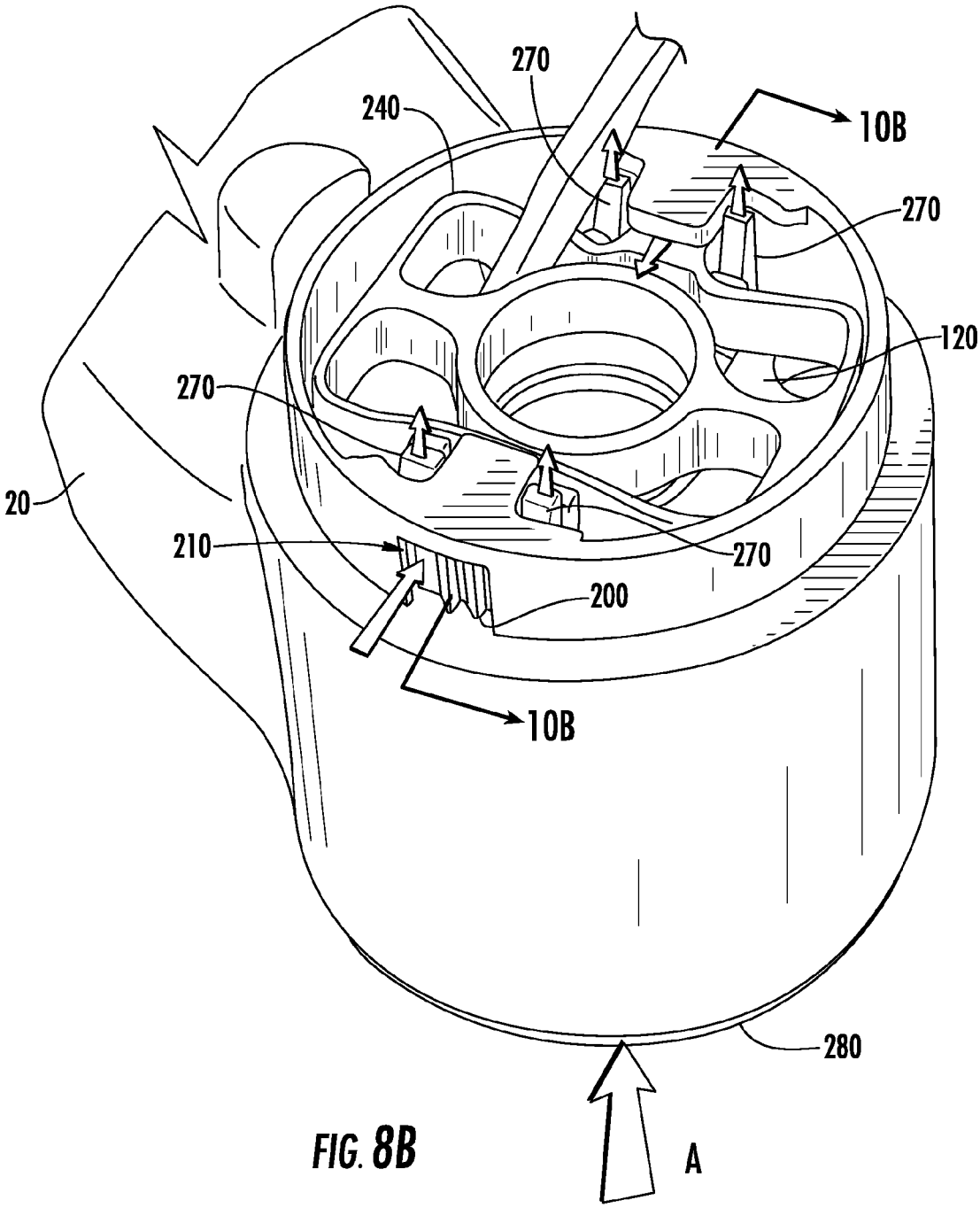
Figure 9:
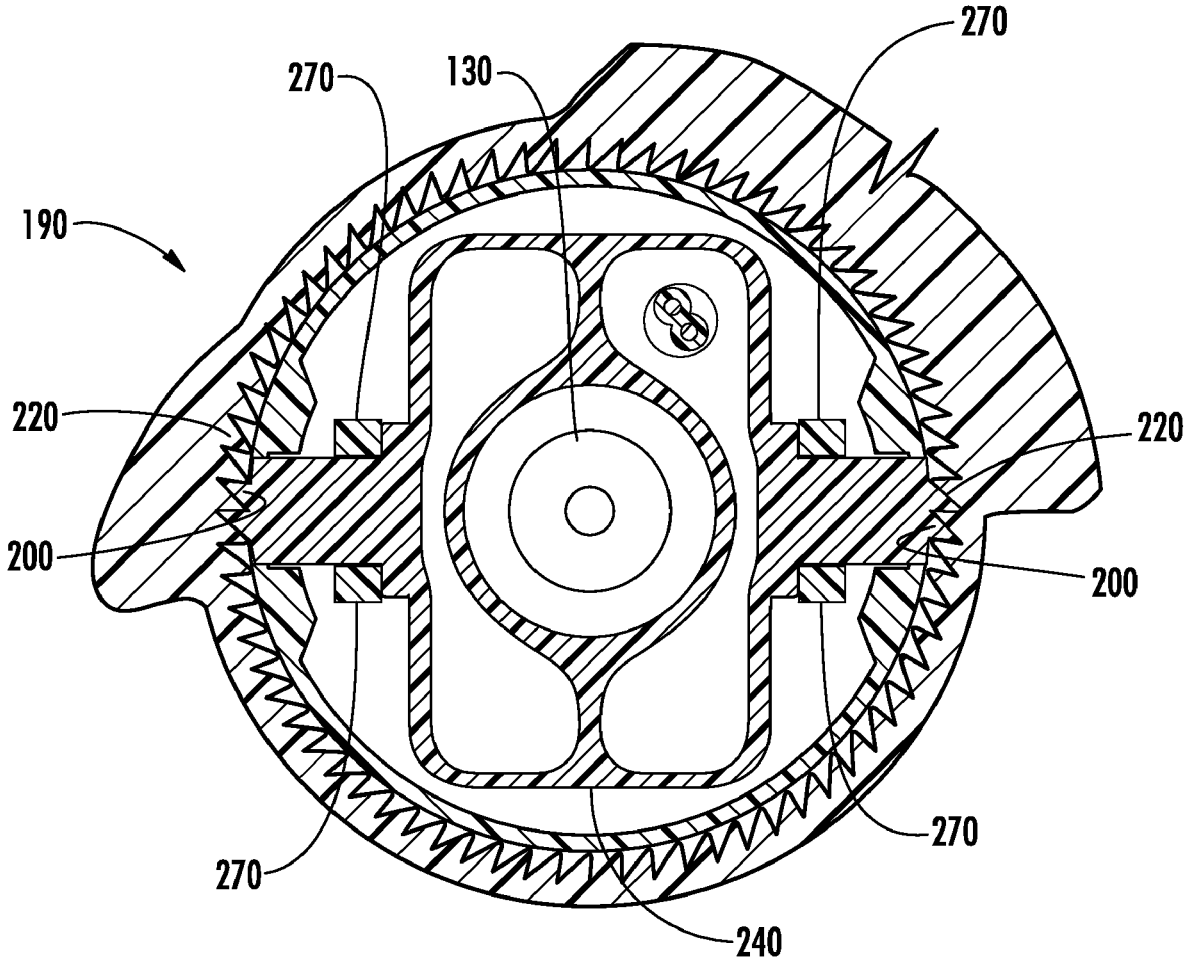
Figure 10A:
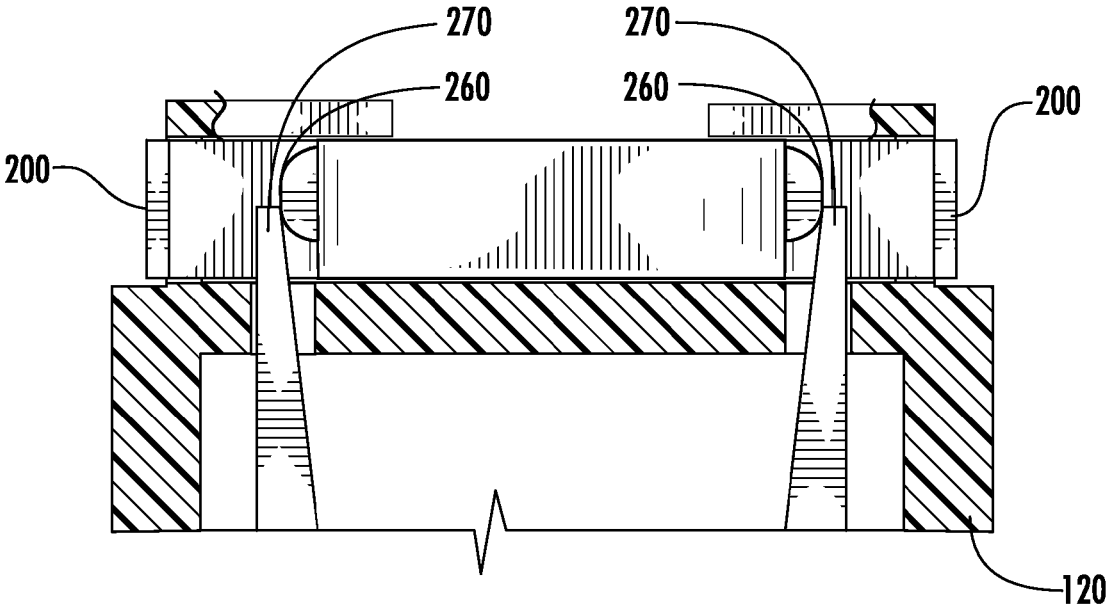
Figure 10B:
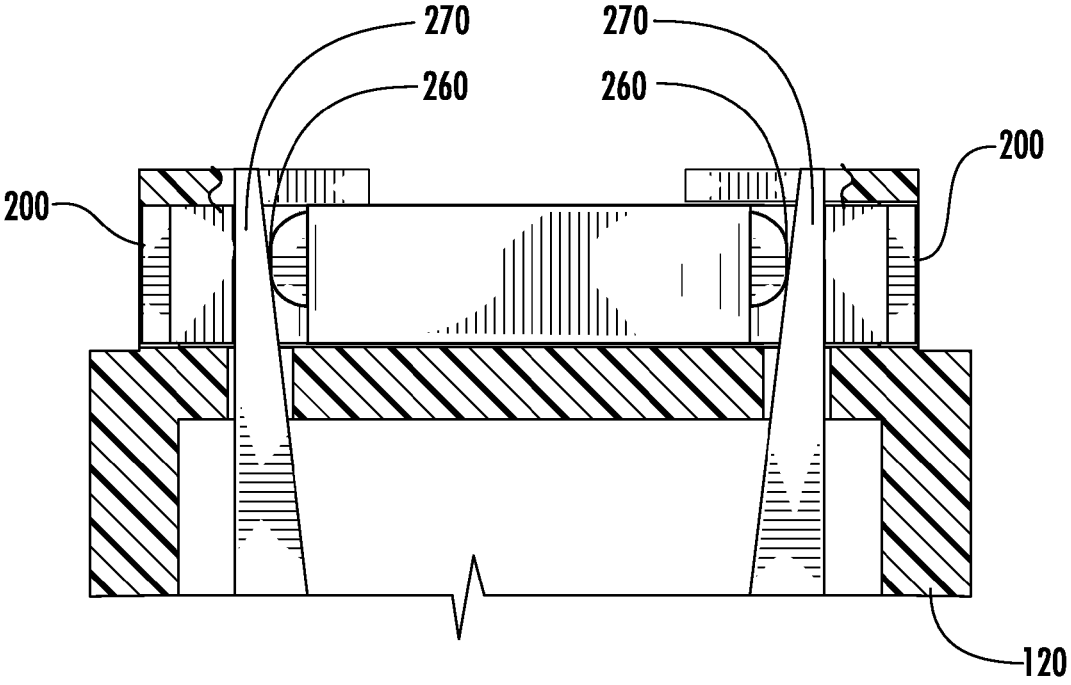
Figure 11:
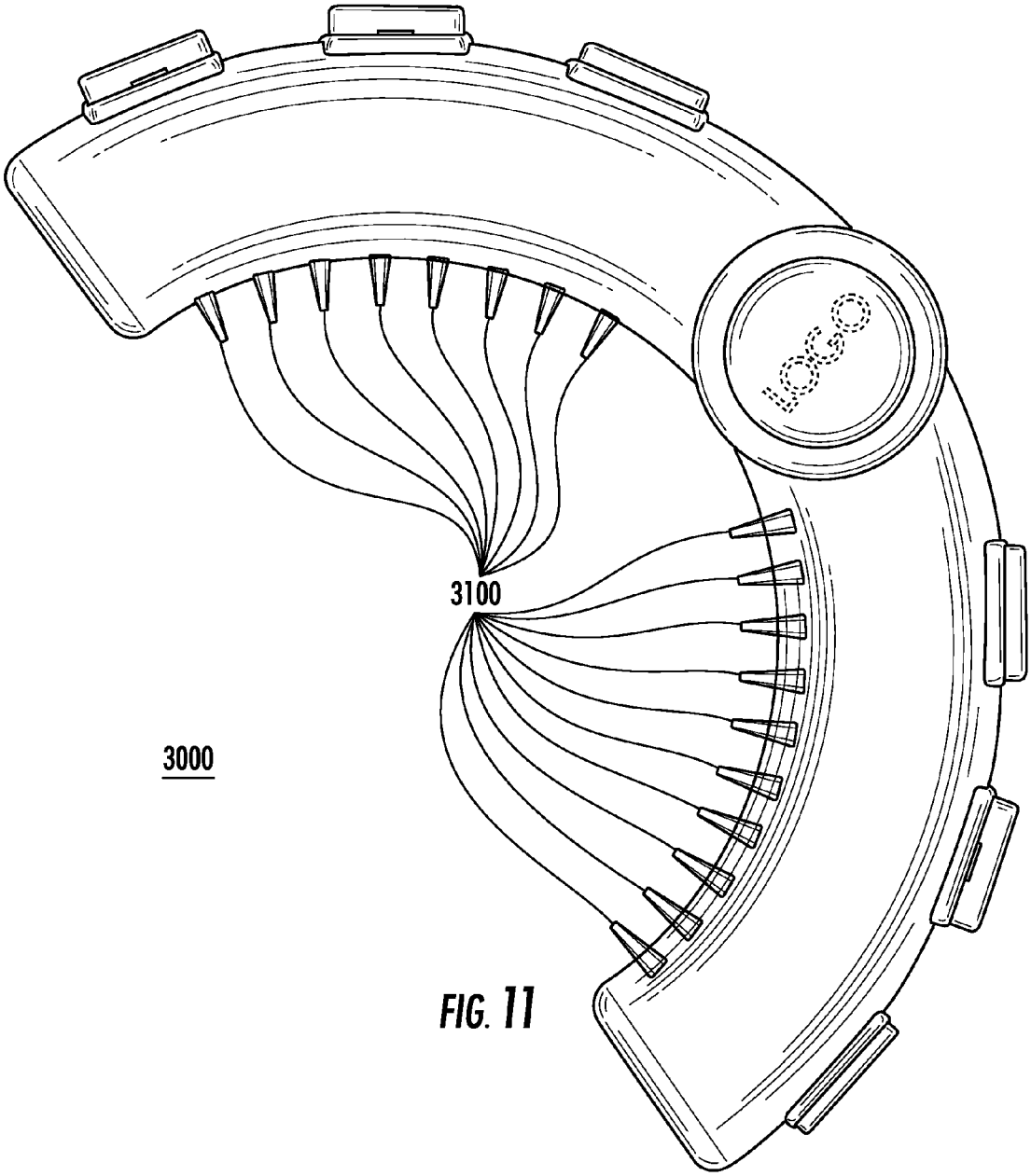
Figure 12:
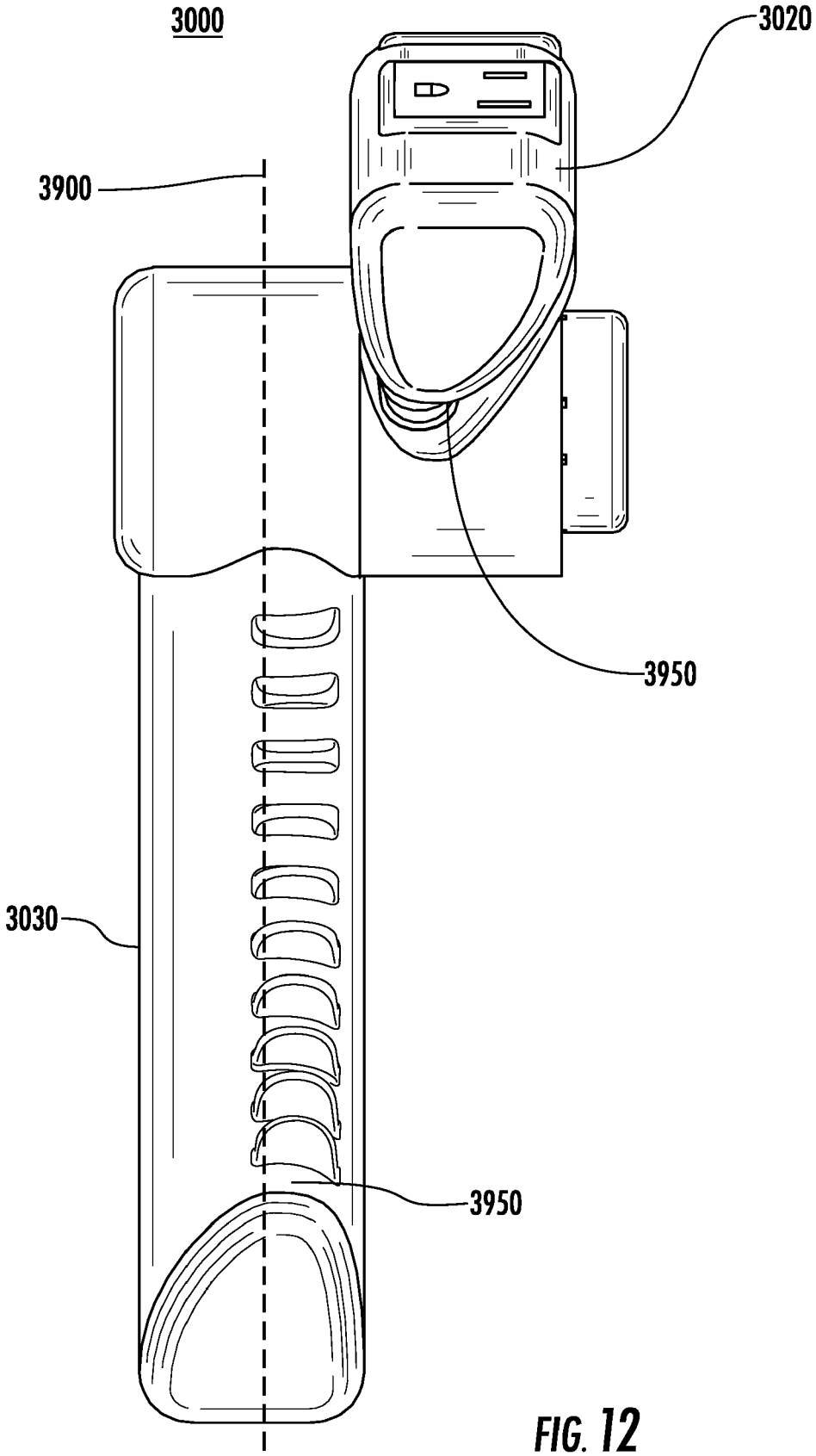
Figure 13:
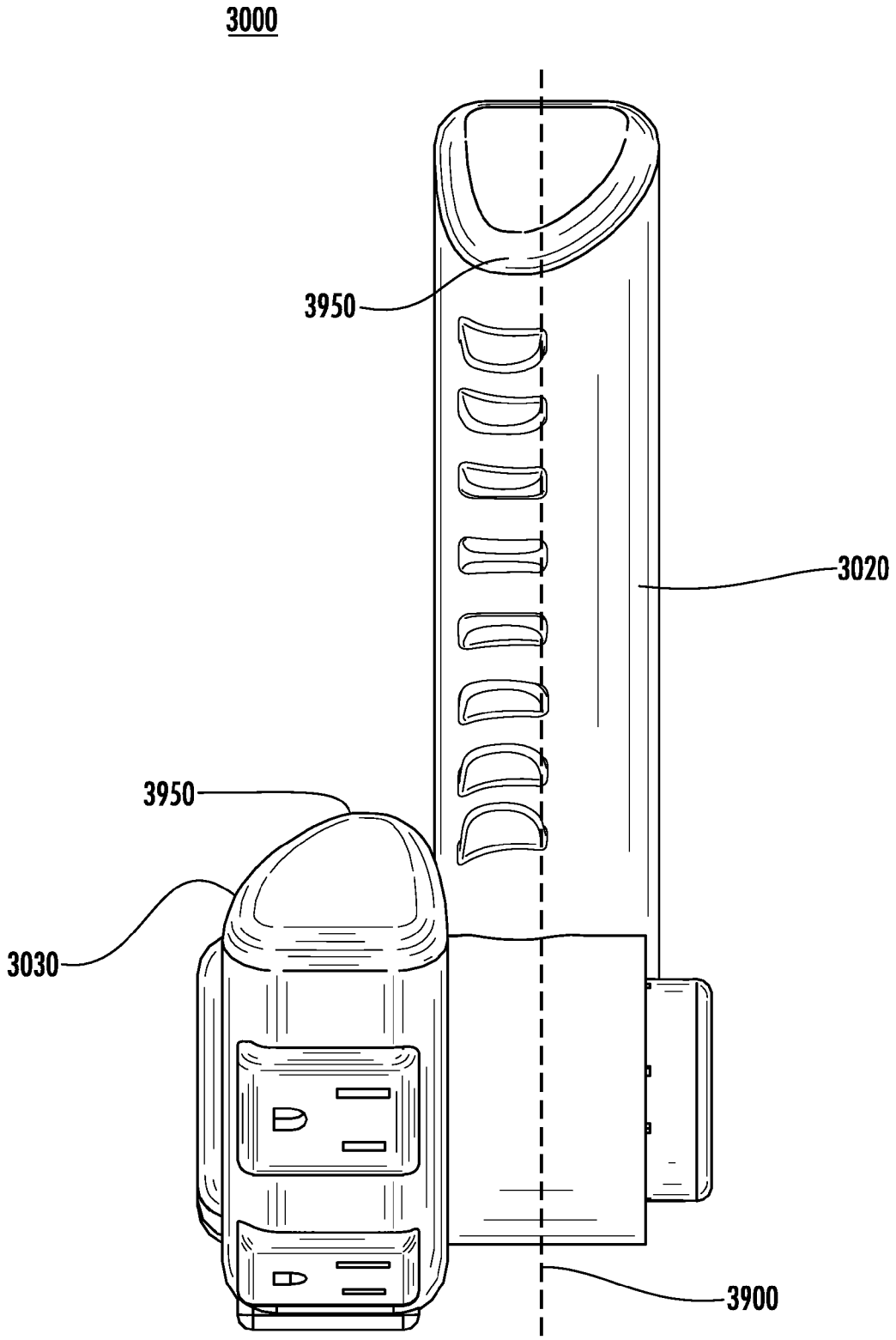
Figure 14:
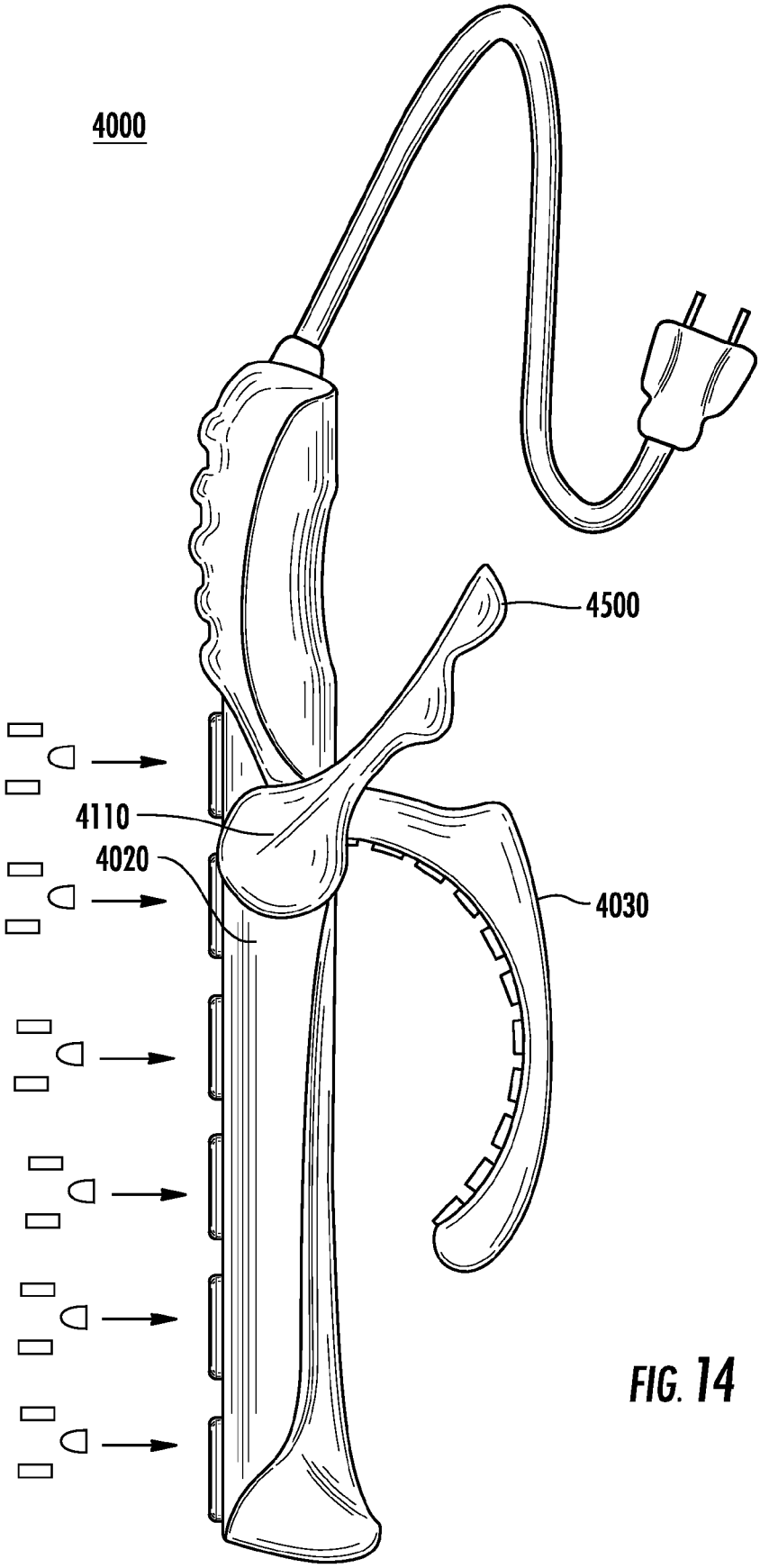
Figure 15:
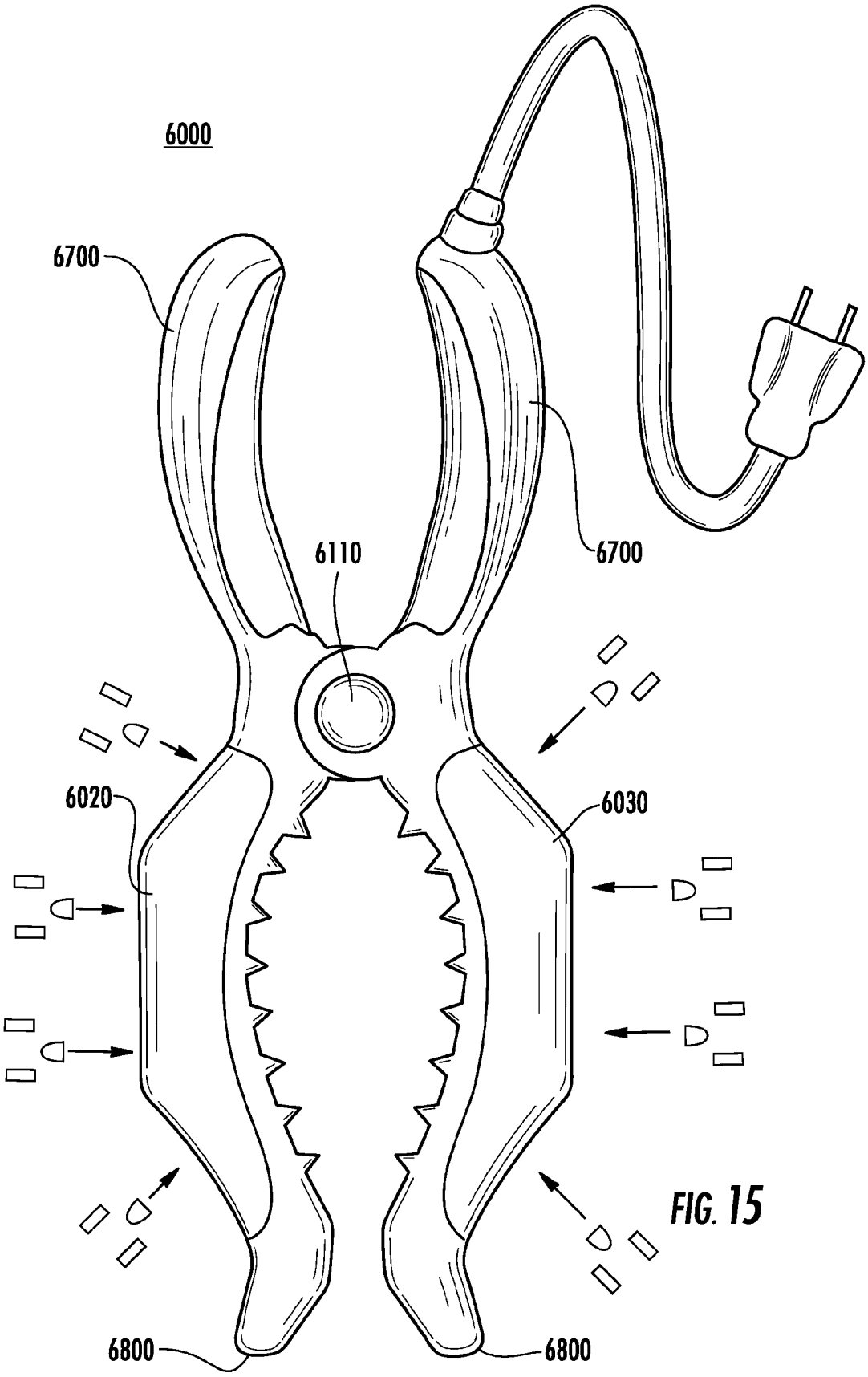
Figure 16:
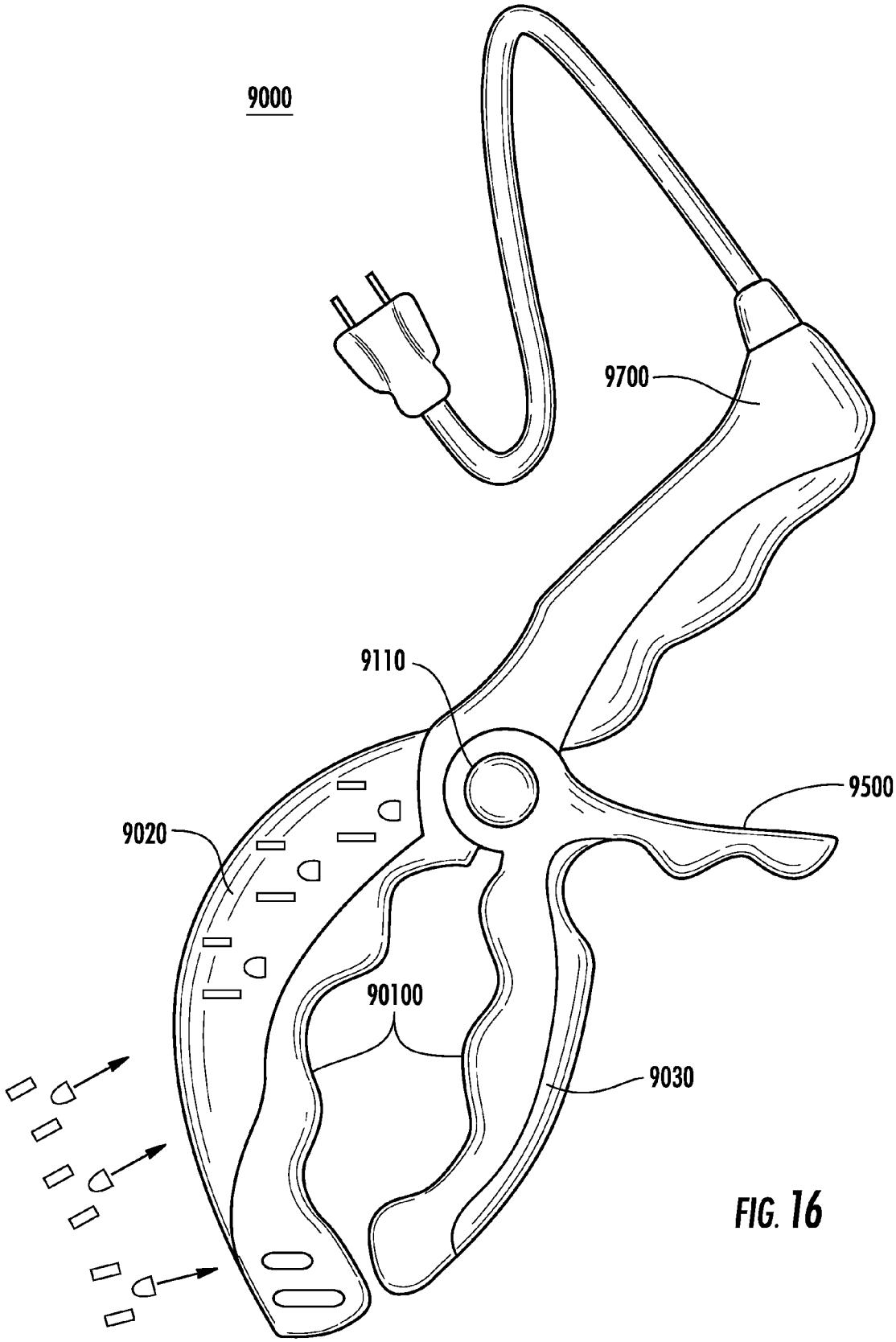
Figure 17:
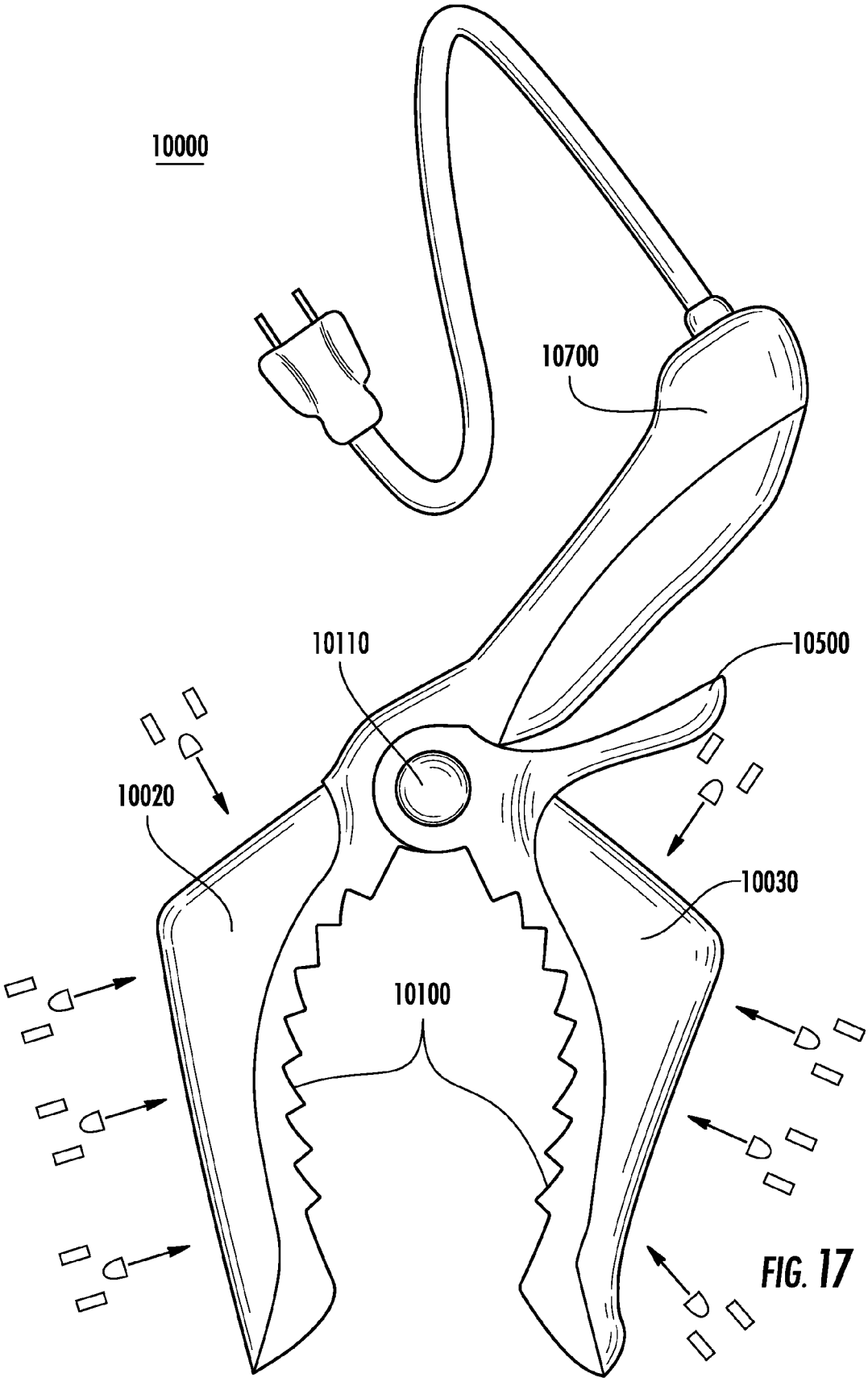
Figure 18:
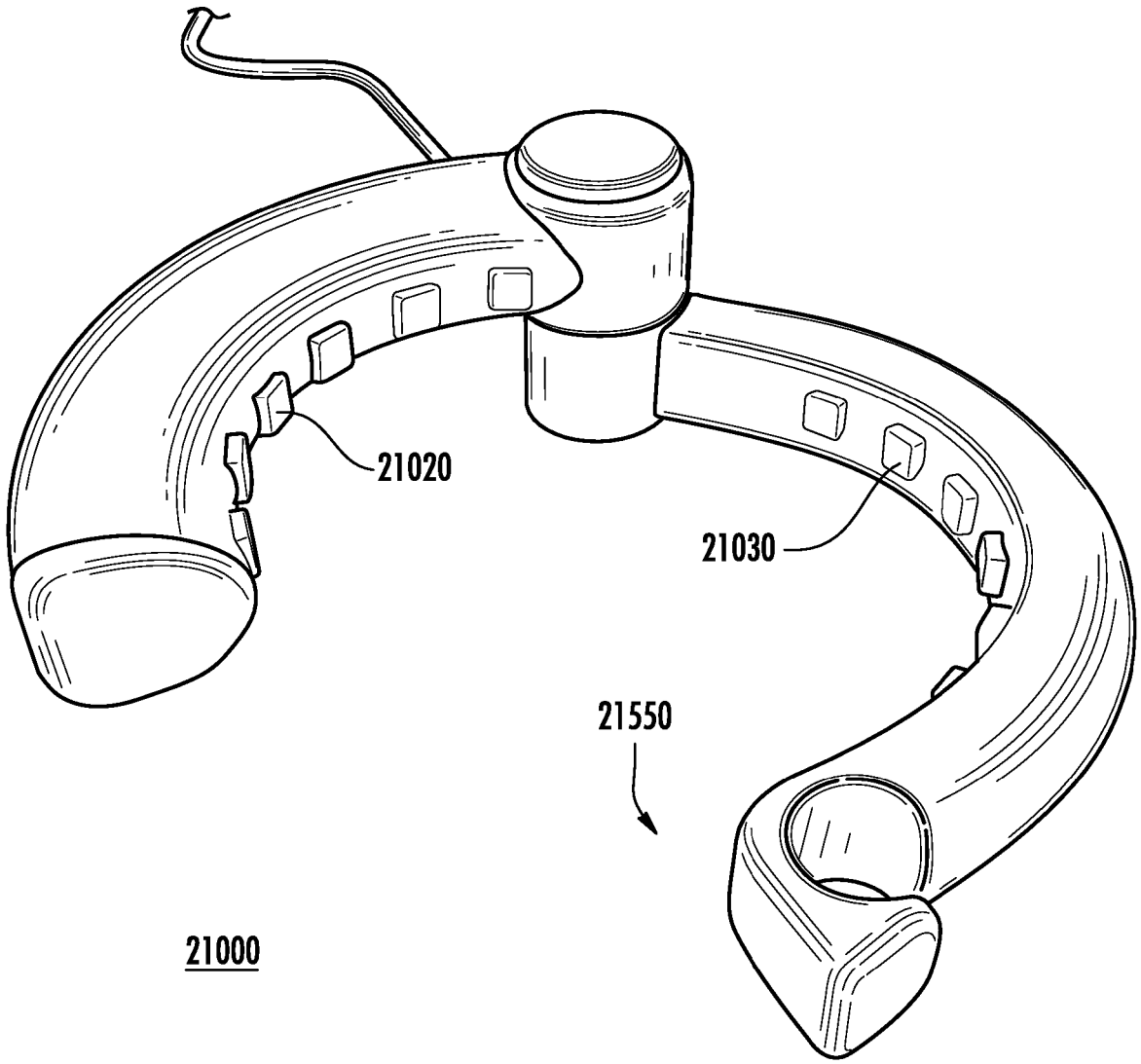
Figure 19:
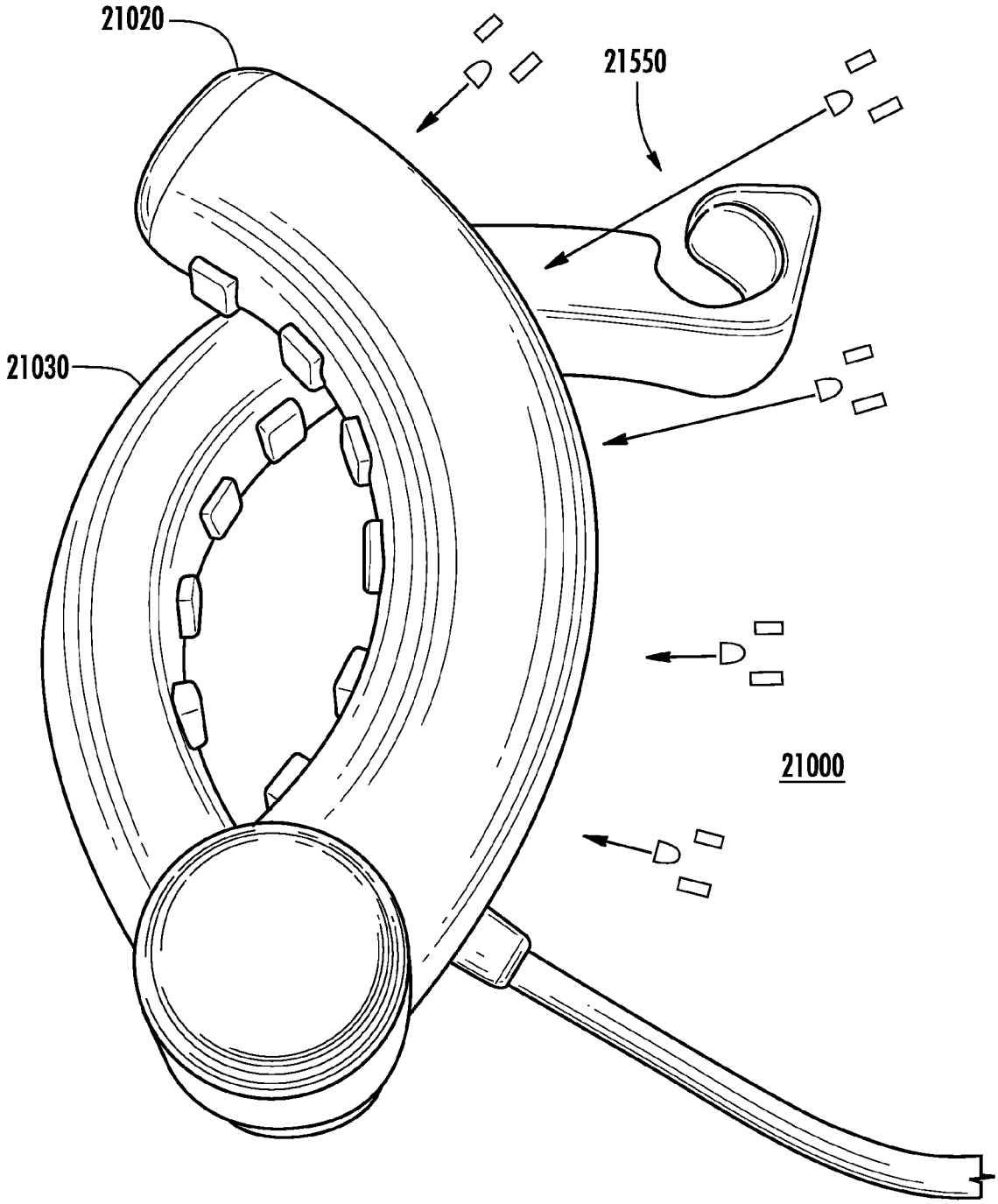

FIG. 3 shows the power strip 10 disposed with arm sections 20,30 in an open position, which is obtained by the pressing of a release member 280 in the direction of the arrow A;

FIG. 4 shows the power strip 10 disposed with its arm sections 20,30 in a closed position;

FIG. 5 shows a perspective view of a component 240 of the power strip 10 that includes biasing elements 230 and teeth elements 200;

FIG. 6 shows a top plan view of the component 240 of FIG. 5, and FIG. 7 shows a side plan view of the component 240 of FIG. 5;

FIG. 8A shows the disposition of the component 240 of FIG. 5 when assembled with other components of the power strip 10, wherein the teeth elements 200 of the component 240 of FIG. 5 are in a protracted state;

FIG. 8B shows the disposition of the component 240 of FIG. 5 relative to the other components of the power strip 10 when the release member 280 is depressed, wherein the teeth elements 200 of the component 240 of FIG. 5 are displaced into a retracted state;

FIG. 9 shows a cross-sectional view of the power strip 10 taken along the line 9-9 of FIG. 2;

FIG. 10A shows a partial cross-sectional view of components of the power strip 10 when the teeth elements 200 of the component 240 of FIG. 5 are in a protracted state;

FIG. 10B shows a similar partial cross-sectional view of components of the power strip 10 when the teeth elements 200 of the component 240 of FIG. 5 are in a retracted state;

FIGS. 11-13 illustrate a power strip in accordance with another embodiment of the invention;

FIG. 14 illustrates a power strip in accordance with another embodiment of the invention;

FIG. 15 illustrates a power strip in accordance with another embodiment of the invention;

FIG. 16 illustrates a power strip in accordance with another embodiment of the invention;

FIG. 17 illustrates a power strip in accordance with another embodiment of the invention;

FIGS. 18-19 illustrate a power strip in accordance with another embodiment of the invention; and FIGS. 20-24 illustrate a power strip in accordance with yet another embodiment of the invention.

VI. DETAILED DESCRIPTION

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

A. First Illustrated Embodiment

Turning now to the drawings and, in particular to FIGS. 1-10B, a power strip 10 in accordance with a first embodiment of the invention is described. The power strip 10 generally comprises the following main components: a plurality of arm sections 20,30; a coupling assembly 110; and a ratcheting assembly 190.

1. Arm Sections

The arm sections of the first illustrated embodiment comprise a first arm section 20 and a second arm section 30. Each of the arm sections 20,30 includes standard three-prong electrical receptacles 40 into which electrical plugs may be individually inserted for powering lights conventionally used on a Christmas tree. For example, each arm section 20,30 as shown in the power strip 10 of the first illustrated embodiment includes three electrical receptacles 40. The electrical receptacles 40 of a respective arm section 20,30 are positioned adjacent each other along a curved length of the respective arm section to define a row or "strip" 50 of electrical receptacles 40. Internal wiring extends through the coupling assembly 110 and arm sections 20,30 for supplying each row 50 of receptacles 40 with power.

Furthermore, while the power strip 10 includes a single row of three receptacles per arm section, any number of receptacles may be included along a particular arm section of a power strip in accordance with the invention. Thus, for example, an arm section may include a row of four or six receptacles. Moreover, different arm sections of the same power strip may include rows having different number of receptacles, or none at all, if desired.

A main power cord 60 of the power strip 10 supplies power to the internal wiring and each of the rows of electrical receptacles. The main power cord 60 extends from the second arm section 30 of the power strip 10 to a standard electrical outlet of a building (not shown). A floor switch 70 optionally is provided for turning on and off of the power strip 10 by depressing of a button of the floor switch. As the floor switch 70 is disposed on the floor, the floor switch 70 may be operable with a foot. The floor switch 70 also may be illuminated when power is provided to the power strip 10.

Each of the arm sections 20,30 includes a rigid, arcuate portion 80 that is formed from a hard material through one or more molding processes. The molding processes may include injection molding, rotational molding, and/or blow molding. Each arm section 20,30 also includes an outer resilient portion 90 that is elastic and capable of resuming its prior shape after deformation. This resilient portion 90 of each arm section 20,30 preferably comprises an over molded portion having resilient protuberances 100 for tensioned gripping. The tensioned gripping results from compression of the resilient protuberances 100 that occurs when the arm sections 20,30 are forced into a closed position about an object upon which the power strip 10 is to be mounted.

2. Coupling Assembly

The coupling assembly 110 of the power strip 10 of the first illustrated embodiment serves to couple the two arm sections 20,30 together. The coupling assembly 110 includes a rim cap 120 (the top of which is shown in FIGS. 2-4; a portion of a bottom surface of which is shown in FIGS. 5A and 5B; and a partial cross-sectional view of which is shown in FIGS. 10A and 10B). The rim cap 120 is partially received within a cylindrical recess of the first arm section 20 and is fastened to an axle portion 130 of the second arm section 30 by a fastener in the form of a screw (not shown with respect to the power strip 10, but illustrated with respect to the power strip 1110 in FIGS. 13A, 13B, and 18). The screw extends through an axial opening 140 of the axle portion 130 of the second arm section 30 and is kept from passing completely through and out of the axial opening 140 by the head of the screw and/or by a washer or bushing (not shown) that abuts an exterior surface of the second arm section 30. The threaded portion of the screw is received and retained within a mating threaded portion (not shown) of the rim cap 120. With reference to FIG. 3, the first arm section 20 is retained by the rim cap 120 to the second arm section 30 by a circular flange of the rim cap 120 (which is the portion of the rim cap 120 shown in FIG. 3). This circular flange is not received within the cylindrical recess of the first arm section 20 but, instead, is disposed in abutting engagement with a surrounding edge 150 of the cylindrical recess of the first arm section 20 as shown in FIG. 3.

Because the rim cap 120 is secured to the axle portion 130 of the second arm section 30 by the screw in coaxial relation thereto, the rim cap 120 is capable of rotational motion about an axis of the axle portion 130. Furthermore, the rim cap 120 is disposed in fixed rotational disposition relative to the first arm section 20 about the axis of the axle portion 130 by ribs (not shown) of the rim cap 120 that axially extend along the outer side of the rim cap 120 and that are received within slots (not shown) of the cylindrical recess of the first arm section 20. Accordingly, the first arm section 20 is thereby coupled to the second arm section 30 for rotational movement relative to the second arm section 30 about this axis. This rotational movement of the arm sections 20,30 relative to one another is illustrated in FIGS. 2-4. It will also be apparent from FIGS. 2-4 that the arm sections 20,30 are offset from one another and are not generally coplanar with one another. This offset disposition permits the distal ends of the arm sections 20,30 to extend beyond the point where the distal ends of the arm sections 20,30 would otherwise meet if the arm sections 20,30 were in generally coplanar disposition. Because of this, the power strip 10 can be mounted to an object having a smaller diameter or cross-section than otherwise would be the case if the arm sections 20,30 were generally coplanar.

Additionally, in order to inhibit repetitive circular motion of the arm sections 20,30 relative to one another, which would tend to cause winding of any wires extending between the arm sections 20,30 through the coupling assembly 110, stops preferably are provided for limiting the range of the rotational movement. In this respect, a stop 160 is provided on the first arm section 20 and a corresponding stop 170 is provided on the second arm section 30. The stops 160,170 are configured to move into abutment with each other in order to limit the extent to which the first arm section 20 and second arm section 30 may be rotated in the direction shown by the respective arrows B,C in FIG. 4. Another corresponding stop 180 (shown in FIG. 5A) also is provided on the second arm section 30. The stops 160,180 also are configured to abut each other to limit the extent to which the first arm section and second arm section may be rotated in the direction shown by the respective arrows B,C in FIG. 3.

3. Ratchet Assembly

The ratchet assembly 190 defines stepped or degrees of relative rotational movement between the first arm section 20 and the second arm section 30. The ratchet assembly in operation is best shown in the partial cross-sectional view of FIG. 9. Preferably, the ratchet assembly 190 also selectively permits rotational movement of the arm sections 20,30 toward one another (i.e., in the direction shown by the arrow in FIG. 4) while precluding rotational movement of the arm sections 20,30 away from one another (i.e., in the direction shown by the arrow in FIG. 3).

In this respect, the ratchet assembly 190 includes inclined teeth elements 200 disposed in the cylindrical recess of the first arm section 20 that extend in a protracted state through oppositely disposed openings 210 of the first arm section 20 (one opening 210 of which is shown in FIGS. 5A and 5B). In the protracted state, the teeth elements 200 engage corresponding inclined teeth elements 220 that are disposed along an inner cylindrical area of the second arm section 30.

Each of the teeth elements 200 is urged into engagement with the inclined teeth elements 220 by a respective biasing element 230 (FIG. 5). Due to the shape of the inclined teeth 200 and 220 and their relative dispositions, the ratchet assembly 190 permits relative rotational movement between the first arm section 20 and the second arm section 30 toward one another and precludes or inhibits relative rotational movement between the first arm section and the second arm section away from one another. Further, as will be appreciated from the drawings, the interlocking engagement between the teeth elements 200,220 is disposed generally opposite each other about the pivot axis. Opposed sides of the lower arm section 30 thereby are locked against the prohibited rotational movement. The ratchet assembly 190 further defines increments in the direction of permitted rotational movement.

The biasing elements 230 include spring-like characteristics and are retained on the axle portion 130 of the second arm section 30 for rotation about the axis of the axle portion 130 with the first arm section 20. Furthermore, as shown in FIG. 5, for example, the teeth elements 200 and the biasing elements 230 preferably are integrally formed as a single piece comprising a double bowspring component 240. Apart from the teeth elements 200 and the biasing element 230, the double bowstring component 240 includes a circular mounting element 250 through which the axle portion 130 of the second arm section 30 is received; and bearing surfaces 260 against which release arms 270 of a release member 280 abut in slidable disposition relative thereto.

Preferably, while the biasing elements 230 urge interlocking engagement of the teeth elements 200,220, the spring force preferably is not so great as to preclude release of the arm sections 20,30 if a great amount of torque is applied so that irreparable damage to the power strip 10 that otherwise would occur is avoided.

The release member 280 comprises a portion that is exposed and serves as a "button" for release of the locking engagement of the ratchet assembly 190 and may include the word "PUSH" or other indicia, such as a logo or trademark, disposed thereon. The release member 280 is retained within the rim cap 120 and is configured to slide back and forth in the direction and counter direction of the arrow "A" shown in FIG. 3. Moreover, the release arms 270 of the release member 280 extend through openings in the bottom of the rim cap 120 to engage the bearing surfaces 260 of the double bowspring component 240 as shown in FIG. 10A, whereby the release member is biased into a disposition in which the release "button" is raised relative to the circular flange of the rim cap 120.

In operation, the power strip 10 may be clamped onto an object or portion thereof, such as, for example, a trunk or branch of a tree, a stud in a building under construction, or a work bench or work table. By depressing the release member 280, the two arm sections 20,30 are released from a locked condition to an unlocked position and can be freely moved within their relative range of motion about their mutual pivot axis. The power strip 10 then can be positioned such that the object is disposed between the arm sections 20,30. Upon ceasing depression of the release member 280 (which is biased by the biasing elements 230), the arm sections 20,30 will return to the locked condition such that movement of the arm sections 20,30 toward one another is permitted but movement of the arm sections 20,30 away from one another is precluded or inhibited. The arm sections 20,30 then can be closed in tight fitting disposition on the object located there between for mounting of the power strip 10 to the object.

To further facilitate mounting of the power strip 10, a further biasing member may be included in the assembly for biasing the arm sections 20,30 away from one another such that the arm sections 20,30 will automatically open when the release member 280 is depressed. Such a biasing member may comprise a torsion spring (not shown in power strip 10) that is located on the axle portion 130 of the lower arm section 30 and that has opposed ends fixedly attached to both arm sections 20,30.

Alternative clamp-on power strips now are illustrated which serve to highlight several variations on the clamp-on power strip 10 of FIGS. 1-10.

B. Second Illustrated Embodiment

A power strip 3000 in accordance with a second illustrated embodiment is shown in FIGS. 11-13. The power strip 3000 generally includes the same construction as power strip 10 and comprises the same main components as the power strip 10 of FIGS. 1-10, including: a plurality of arm sections; a coupling assembly; and a ratcheting assembly.

One difference over the previous illustrated power strips 10,1110 that is illustrated by power strip 3000 relates to the form of the resilient protuberances for tensioned gripping that are disposed on the inner concave portion of the arm sections. In the power strip 3000, the resilient protuberances include bendable or flexible fingers 3100, which in use may better conform to and provide a better grip on the object to which the power strip 3000 is mounted. The protuberances 3100 also are aligned in two generally parallel rows, each row of which is generally offset from a centerline 3900 of its respective arm section 3020,3030 in a direction toward the other row of the other arm section 3020,3030. This arrangement of the two rows of protuberances 3100 is best seen in FIGS. 12 and 13. In other words, the arm sections 3020,3030 themselves are offset from one another, as consequently are the protuberances 3100; however, the protuberances 3100 are not offset to the same extent as the arm sections 3020,3030.

Each arm section 3020,3030 further includes a profile that is not symmetrical along the centerline 3900 of the arm section, again as best shown in FIGS. 12 and 13. Instead, the profile of each arm section 3020,3030 includes a rounded edge 3950 that is offset toward the other arm section 3020, 3030, with the protuberances 3100 on each arm section 3020, 3030 extending long this rounded edge 3950.

C. Third Illustrated Embodiment

A power strip 4000 is illustrated in FIG. 14 that includes a spring-biased lever arm 4500 with finger grips for spring-biased clamping of an object between arm section 4020 and an arm section 4030. The arm sections 4020,4030 are joined at pivot coupling 4110. Further in this respect, the lever arm 4500 and the arm section 4030 preferably are disposed in fixed position relative to each other. Additionally, in the power strip 4000, electrical receptacles are only provided on arm section 4020. In this respect, arm section 4020 includes six electrical receptacles.

D. Fourth Illustrated Embodiment

A power strip 6000 is illustrated in FIG. 15 and includes spring-biased arm sections 6020,6030. Each arm section includes four electrical receptacles, and the arm sections are biased toward one another by an internal biasing component (not shown) disposed at the pivot coupling 6110, which biasing component provides the clamping force for mounting of the power strip 6000 to an object. Handle grips 6700 also are provided in the power strip 6000 and are formed by each of the arm sections, whereby the power strip overall resembles a clamp found in jumper cables for a car battery. The arm sections further include end portions 6800 that define guides against which a user can push an object, thereby parting the arm sections 6020,6030 for mounting of the power strip 6000 onto the object.

E. Fifth Illustrated Embodiment

A power strip 9000 is illustrated in FIG. 16 and includes a spring-biased lever arm 9500 with finger grips for spring-biased clamping of an object between arm section 9020 and an arm section 9030. The arm sections 9020,9030 are joined at pivot coupling 9110. Further in this respect, the lever arm 9500 and the arm section 9030 preferably are disposed in fixed disposition relative to each other and may be integrally formed. Moreover, electrical receptacles are only provided on arm section 9020. In this respect, arm section 9020 includes six electrical receptacles. Furthermore, half of the receptacles are disposed on a first side of the arm section 9020, and the other half are disposed on a second side of the arm section 9020 that, generally, is orthogonally disposed to the first side. In other words, a row of receptacles extends along a top surface of the arm section 9020 and a row of receptacles extends along a side surface of the arm section 9020. Furthermore, teeth 9100 are provided on the interior side of each of the arm sections 9020,9030 for gripping engagement of an object therebetween. The teeth 9100 preferably are formed from a durable, resilient material. A handle 9700 extends from the pivot coupling 9110 and preferably is formed by an extension of the arm section 9020 past the pivot coupling 9110.

F. Sixth Illustrated Embodiment

A power strip 10000 is illustrated in FIG. 17 and includes a spring-biased lever arm 10500 with finger grips for spring-biased clamping of an object between arm section 10020 and an arm section 10030. The arm sections 10020,10030 are joined at pivot coupling 10110. Further in this respect, the lever arm 10500 and the arm section 10030 preferably are disposed in fixed disposition relative to each other and may be integrally formed. Moreover, electrical receptacles are provided in this embodiment on arm section 10020 and on arm section 10030. In this respect, arm section 10020 includes four electrical receptacles, with three of the receptacles being disposed on a first top surface of the arm section 10020, and another receptacle being disposed on a second top top surface of the arm section 10020, which second top top surface is generally oriented at an obtuse angle to the first top top surface of the arm section 10020. The second arm section 10030 includes a mirror arrangement of four receptacles. Furthermore, teeth 10100 are provided on the interior side of each of the arm sections 10020,10030 for gripping engagement of an object therebetween. The teeth 10100 preferably are formed from a durable, resilient material. A handle 10700 extends from the pivot coupling 10110 and preferably is formed by an extension of the arm section 10020 that extends past the pivot coupling 10110.

G. Seventh Illustrated Embodiment

A power strip 21000 is illustrated in FIGS. 18-19. Power strip 21000 is similar in construction to power strip 10, discussed above. A difference illustrated by power strip 21000 is the provision of a hook 21550 at the distal end of arm section 21030 for additional attachment of the power strip to an object that would be too small for mounting between the arm sections. Arm section 21030 also is smaller in cross-section than arm section 21020 and includes no electrical receptacles. Arm section 21020, however, includes five electrical receptacles as shown in FIG. 31.

H. Eighth Illustrated Embodiment

Figure 20:
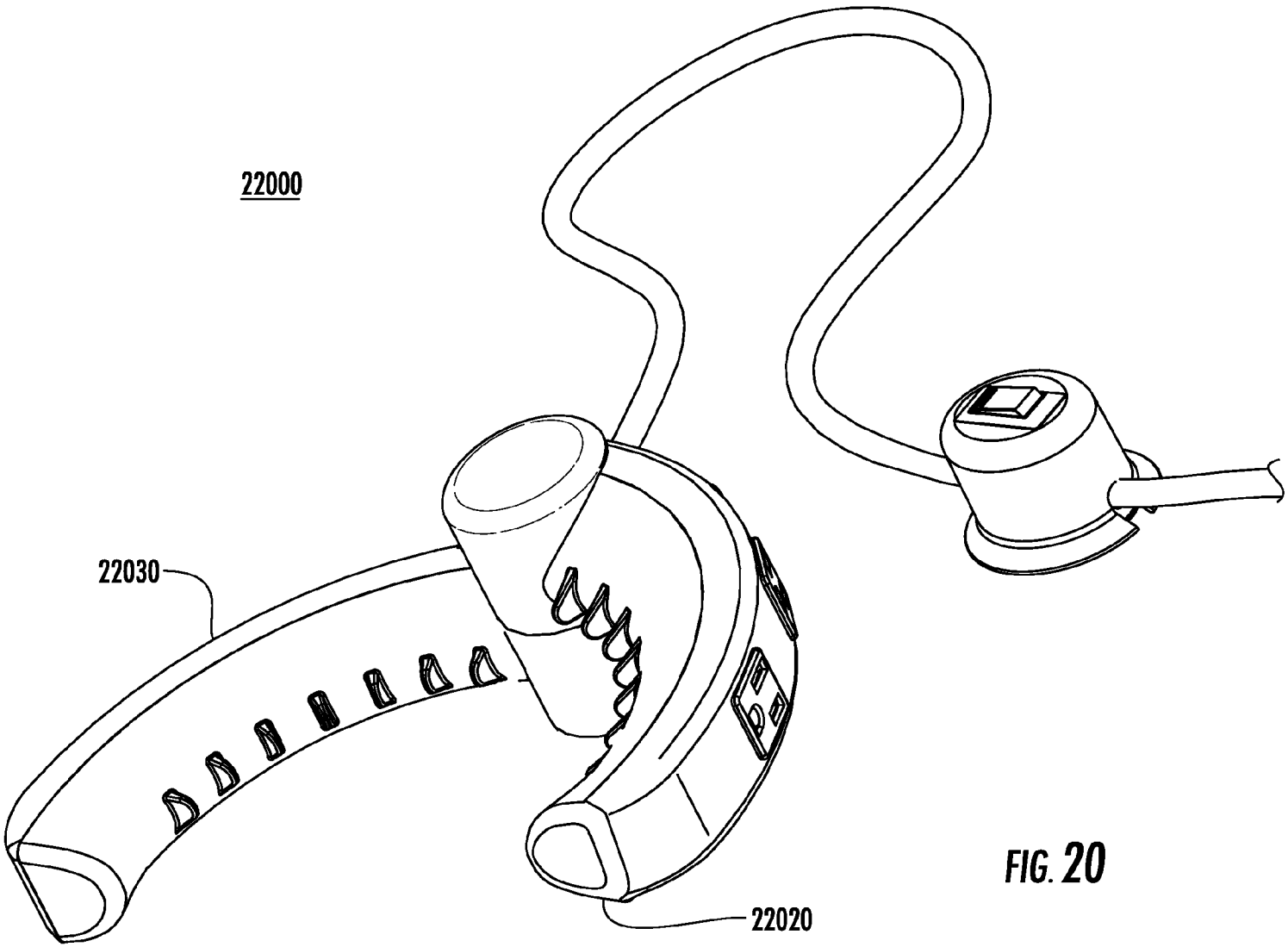
Figure 21:
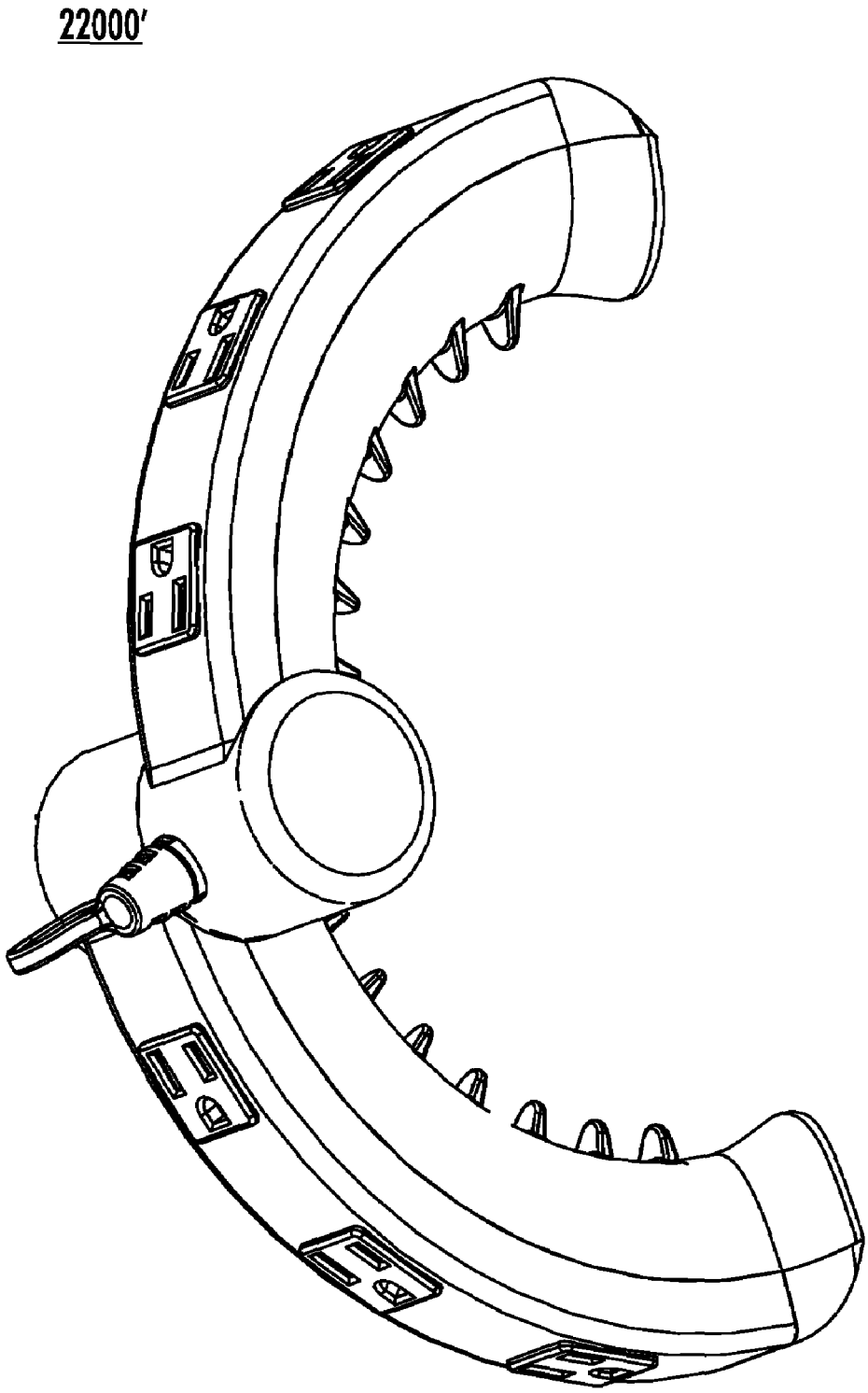
Figure 22:
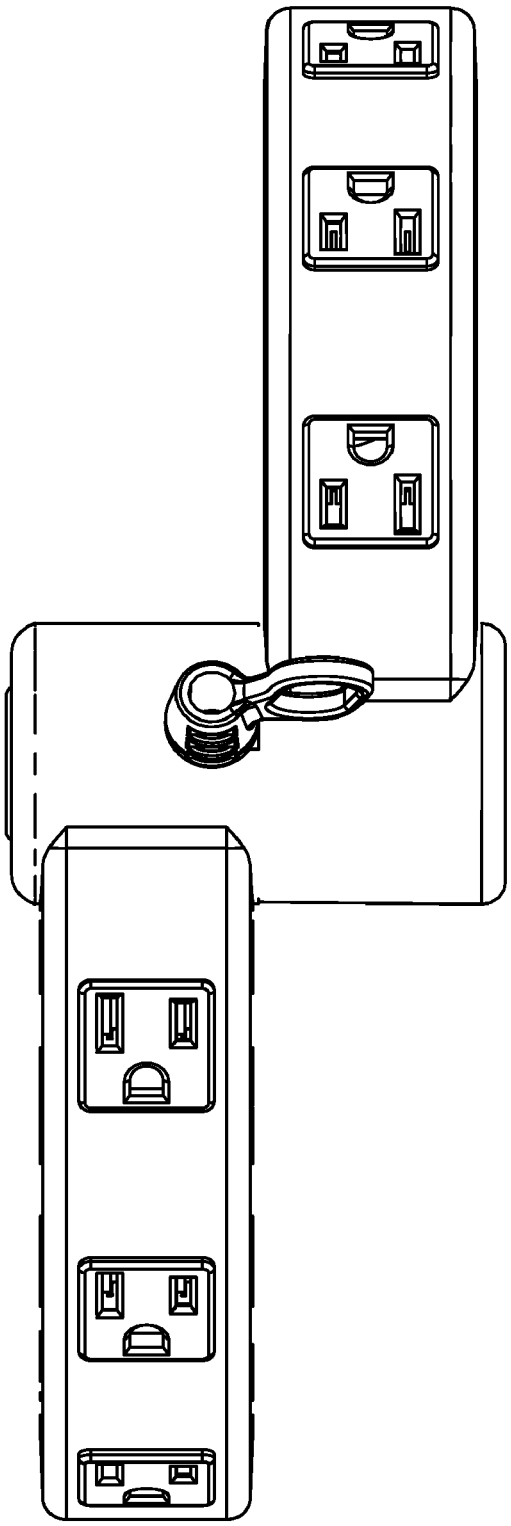

Another power strip 22000 in accordance with a ninth embodiment of the invention is disclosed with respect to FIGS. 20-24. Specifically, FIG. 20 illustrates a perspective view of the power strip 22000 and FIGS. 21-24 illustrate various views of the power strip 22000 in which illustration of the cord and floor switch have been omitted for clarity (hereinafter the power strip is identified and referred to with callout 22000' when the cord and floor switch are not shown in the drawings). The outward appearance and features, and the functioning of, the power strip 22000 correspond to the outward appearance, features, and functions of, for example, the power strip 3000 of FIGS. 11-13. In particular, power strip 22000 includes: a plurality of arm sections 22020,22030; a coupling assembly; and a ratcheting assembly 22190.

With respect to the arm sections 22020,22030 of power strip 22000, each includes three standard, three-prong electrical receptacles 22040 into which electrical plugs may be individually inserted. The electrical receptacles 22040 of a respective arm section 22020,22030 are positioned adjacent each other along a curved length of each respective arm section 22020,22030 to define a row or "strip" of electrical receptacles 22040. Internal wiring including electrical contacts and a ground strip extend through each arm section 22020,22030 for supplying power to the electrical receptacles 22040. A main power cord 22060 of the power strip 22000 supplies power to the electrical contacts by way of internal wiring. The main power cord 22060 extends from the upper arm section 22020 of the power strip 22000 to a standard electrical outlet of a building (not shown). A floor switch 22070 is provided for turning on and off of the power strip 22000 by depressing of a button of the floor switch 22070. As the floor switch 22070 is disposed on the floor, the floor switch 22070 may be operable with a foot. The floor switch 22070 also may be illuminated when power is provided to the power strip 22000.

Each of the arm sections 22020,22030 includes a rigid, arcuate portion 22080 that is formed from a hard material through one or more molding processes. The molding processes may include injection molding, rotational molding, and/or blow molding. Each arm section 22020,22030 also includes an outer resilient portion 22090 that is elastic and capable of resuming its prior shape after deformation. This resilient portion 22090 of each arm section 22020,22030 preferably comprises an over molded portion having resilient protuberances 22100 for tensioned gripping. The tensioned gripping results from compression of the resilient protuberances 22100 that occurs when the arm sections 22020,22030 are forced into a closed position about an object upon which the power strip 22000 is to be mounted.

The form of the resilient protuberances 22100 for tensioned gripping that are disposed on the inner concave portion of the arm sections 22020,22030 include bendable or flexible fingers, which in use conform to and provide good gripping of the object to which the power strip 22000 is mounted. Moreover, each protuberance 22100 is asymmetrical and includes a steeper slope on one side thereof relative to the slope on the other side thereof. The asymmetry of each individual protuberance 22100 is perhaps best seen in FIG. 24.

The protuberances 22100 also are aligned in two generally parallel rows, each row of which is generally offset from a centerline of its respective arm section 22020,22030 in a direction toward the other row of the other arm section 22020, 22030. This arrangement of the two rows of protuberances 22100 is best seen, for example, in FIG. 23.

Figure 23:
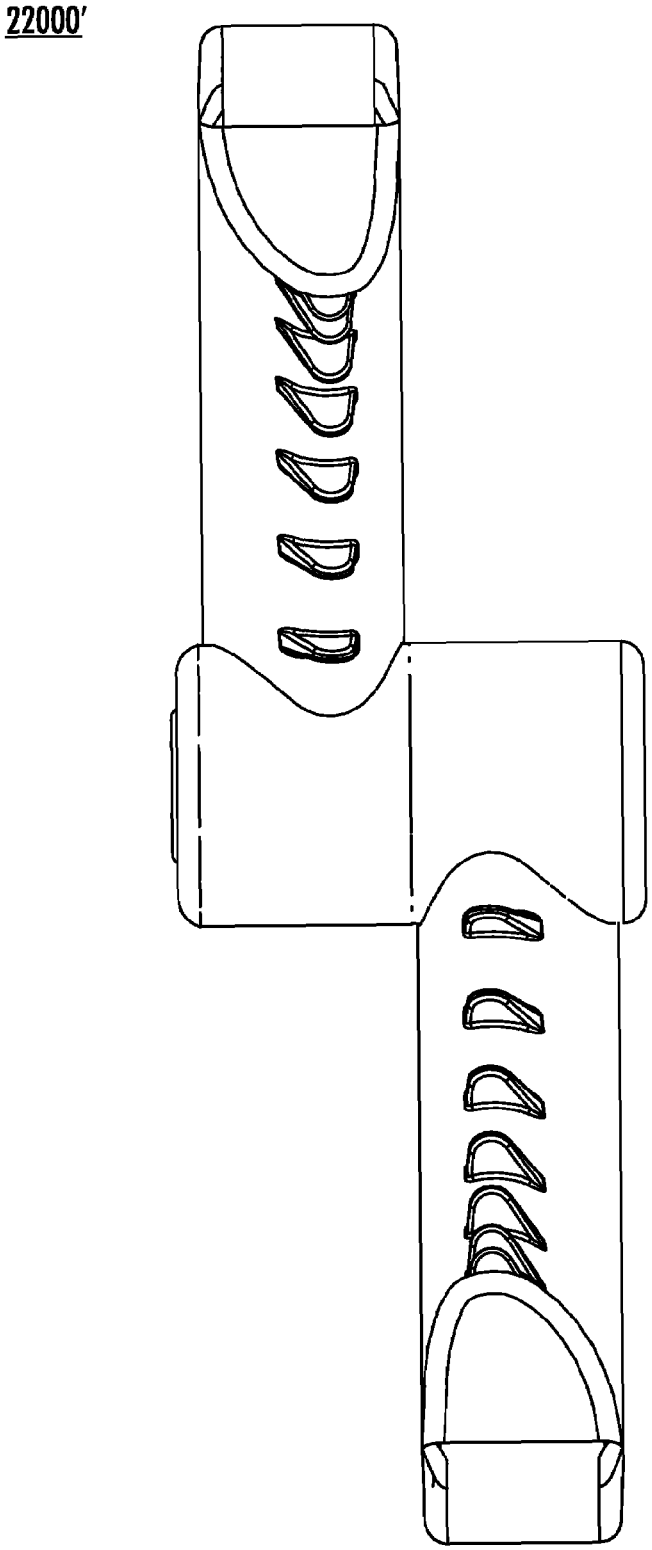
Figure 24:
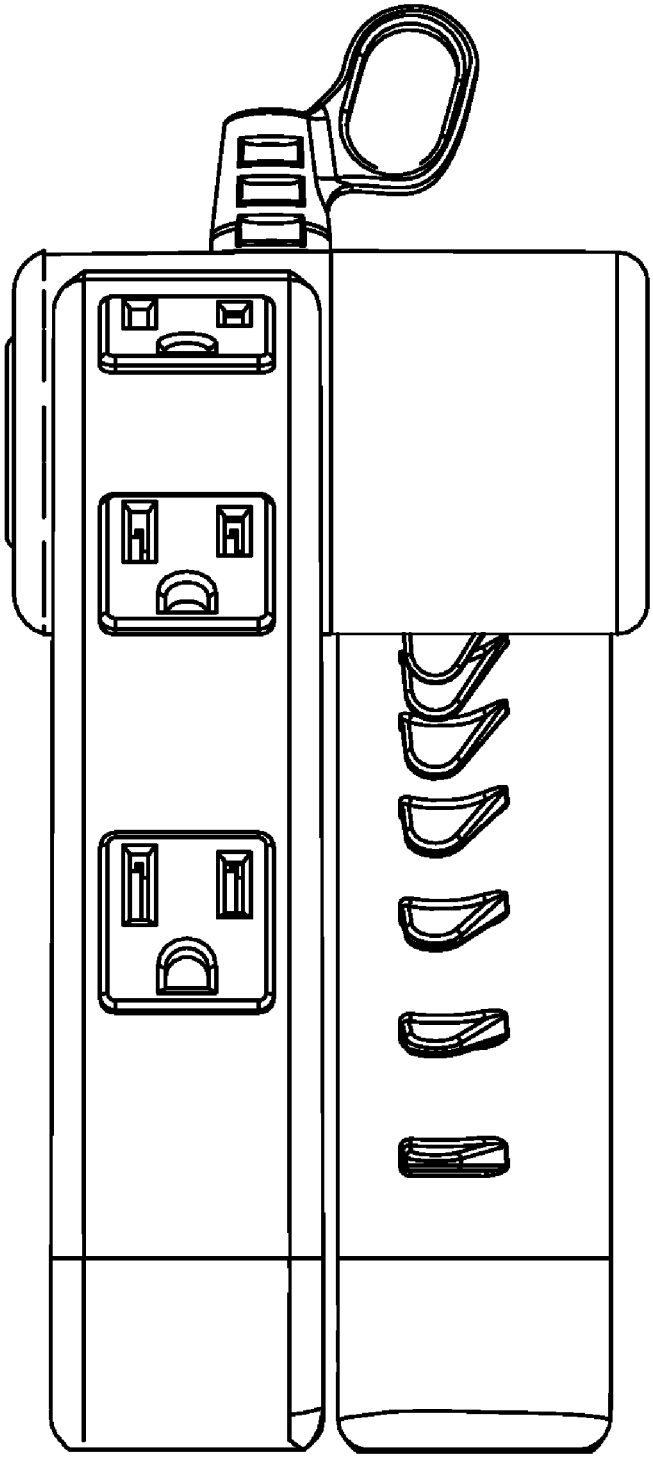

Each arm section 22020,22030 further includes a profile that is not symmetrical along the respective centerline of the arm section, again as best seen, for example, in FIG. 23. Instead, the profile of each arm section 22020,22030 includes a rounded edge that is offset toward the other arm section 22020,22030, with the protuberances 22100 on each arm section 22020,22030 extending along this rounded edge.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A mountable power strip, comprising:

(a) a first arm section, the first arm section including a plurality of electrical receptacles positioned adjacent each other along an extent of the first arm section such that the plurality of electrical receptacles form a strip of electrical receptacles;

(b) a second arm section;

(c) a lever arm connected to the second arm section; and (d) a coupling assembly configured to couple the first and second arm sections together such that the first and second arm sections are configured for rotational movement relative to each other about an axis of the coupling assembly;

(e) wherein the first and second arm sections are configured to transition between, (i) a first configuration, in which the first and second arm sections are oriented in an open position for receipt of an object between the first and second arm sections, and (ii) a second configuration, in which the first and second arm sections are oriented in a closed position, the first and second arm sections being closer to one another than when in the first configuration for clamping engagement with the object.

2. The mountable power strip of claim 1, wherein the first arm section includes an elongate portion along which the strip of electrical receptacles are positioned.

3. The mountable power strip of claim 2, wherein the second arm section is curved.

4. The mountable power strip of claim 1, wherein the first arm section and the lever-arm each includes finger grips for gripping by hand of the first arm section and the lever-arm.

5. The mountable power strip of claim 1, wherein the first and second arm sections each includes an outer resilient portion that is elastic and capable of resuming its prior shape after deformation.

6. The mountable power strip of claim 5, wherein the resilient portion of the second arm section comprises resilient protuberances for tensioned gripping of an object on which the power strip may be mounted.

7. The mountable power strip of claim 6, wherein the resilient protuberances of the second arm section are positioned adjacent each other such that the resilient protuberances define a row of resilient protuberances.

8. The mountable power strip of claim 7, wherein the row of resilient protuberances of the second arm section extends along an arcuate portion of the second arm section.

9. The mountable power strip of claim 1, wherein the lever arm is connected to the second arm section in fixed disposition relative to the second arm section.

10. The mountable power strip of claim 9, wherein the lever arm is spring-biased such that the first and second arm sections are biased toward the closed position

11. The mountable power strip of claim 10, wherein the first and second arm sections are spring-biased toward the closed position.

12. The mountable power strip of claim 1, further comprising a main power cord for supplying electrical power to the electrical receptacles, the main power cord being connected to the first arm section at an end of the first arm section.

13. A method of mounting a power strip on an object, the power strip having first and second arm sections and a lever arm connected to the second arm section, the method comprising the steps of:

positioning the power strip such that the object extends between a first arm section and a second arm section of the power strip, the first arm section including a plurality of electrical receptacles positioned adjacent each other along an extent of the first arm section so as to define a strip of electrical receptacles; and transitioning the first and second arm sections to a closed position wherein the object is gripped between the first arm section and the second arm section.

14. The method of claim 13, wherein the second arm section includes a row of resilient protuberances, at least some of which are compressed by the object for tensioned gripping of the object between the first and second arm sections of the power strip.

15. The method of claim 13, wherein the extent of the first arm section that includes the strip of electrical receptacles is linear.

16. The method of claim 13, wherein the power strip further includes:

(a) a coupling assembly configured to couple the first and second arm sections together such that the first and second arm sections are configured for rotational movement relative to each other about an axis of the coupling assembly;

(b) wherein the first and second arm sections are configured to transition between, (i) a first configuration, in which the first and second arm sections are oriented in an open position for receipt of an object between the first and second arm sections, and (ii) a second configuration, in which the first and second arm sections are oriented in a closed position, the first and second arm sections being closer to one another than when in the first configuration for clamping engagement with the object.

17. The method of claim 16, wherein the first arm section includes an elongate portion along which the strip of electrical receptacles are positioned, and wherein the second arm section is curved.

18. The method of claim 16, wherein the first and second arm sections each includes an outer resilient portion that is elastic and capable of resuming its prior shape after deformation, the outer resilient portions of the arm sections being oriented in opposed facing relationship to each other on an interior side of each arm section, and each resilient portion of each arm section being compressed by the object for tensioned gripping of the object between the first and second arm sections of the power strip.

19. The method of claim 16, wherein the lever arm is connected to the second arm section in fixed disposition relative to the second arm section.

20. The method of claim 16, wherein the lever arm is spring-biased such that the first and second arm sections are biased toward the closed position.

21. The method of claim 13, wherein said step of positioning the power strip includes moving the first arm section and the second arm section apart by moving the lever arm relative to the first arm section.

* * * * *